United States Patent [19]

Sprung et al.

[11] 4,033,772

[45] July 5, 1977

[54] AMPHOTERIC MALEIC ANHYDRIDE COPOLYMERS AND PHOTOGRAPHIC EMULSIONS EMPLOYING THE SAME

[75] Inventors: Joseph A. Sprung, Binghamton; Theodore Panasik, Vestal; James J. Holmes, Endicott, all of N.Y.

[73] Assignee: GAF Corporation, New York, N.Y.

[22] Filed: Dec. 9, 1975

[21] Appl. No.: 639,075

[52] U.S. Cl. ..... 96/114; 96/94 R
[51] Int. Cl.[2] ..... G03C 1/72; G03C 1/02
[58] Field of Search ..... 96/114, 94 R

[56] References Cited

UNITED STATES PATENTS

| | | | |
|---|---|---|---|
| 2,957,767 | 10/1960 | Williams | 96/114 |
| 3,032,522 | 5/1962 | Summers | 96/114 |
| 3,877,947 | 4/1975 | Tsuji et al. | 96/114 X |
| 3,879,205 | 4/1975 | Fitzgerald et al. | 96/114 |
| 3,929,482 | 12/1975 | Ponticello et al. | 96/114 |

*Primary Examiner*—Edward C. Kimlin
*Attorney, Agent, or Firm*—Walter C. Kehm; Edward G. Comrie

[57] ABSTRACT

A photographic silver halide emulsion wherein the emulsion binder comprises the reaction product of 1) a reactant having an amino, mercapto or hydroxy functionality and a cationic active group with 2) a copolymer of maleic anhydride and an ethylenically unsaturated copolymerizable monomer.

42 Claims, 31 Drawing Figures

Figure 3:
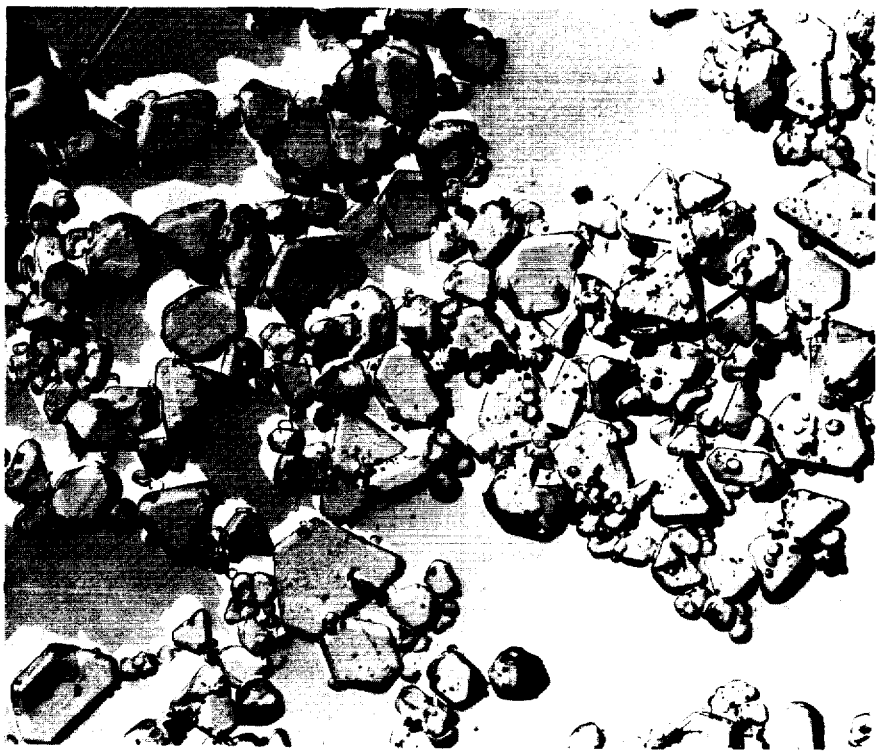

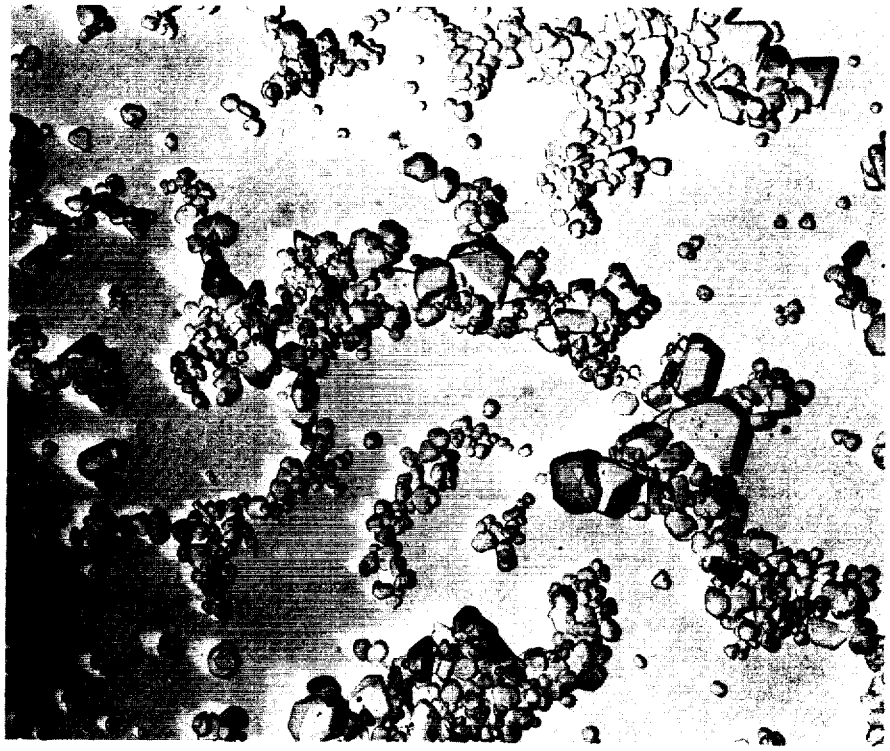
FIG. 1 1 MICRON
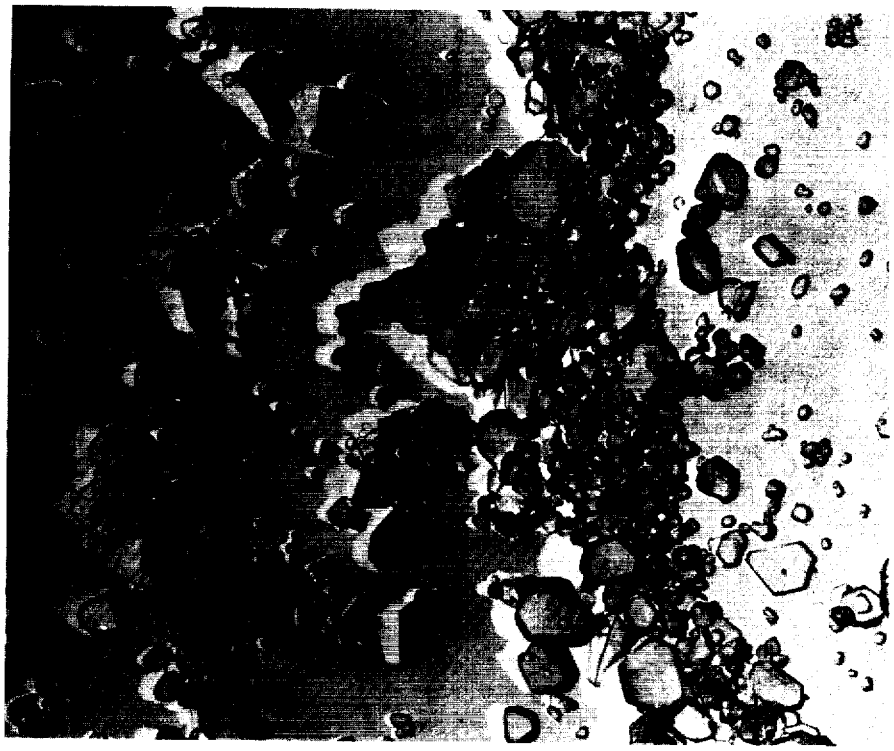
FIG. 2

AMPHOTERIC MALEIC ANHYDRIDE COPOLYMERS AND PHOTOGRAPHIC EMULSIONS EMPLOYING THE SAME

The present invention relates to photographic silver halide emulsions, and more particularly to photographic emulsions of light-sensitive silver halide in an amphoteric copolymer.

Gelatin, which has been used commercially during the past century as the binder for the silver halide crystals in photographic emulsions, plays an important role in establishing the sensitometric characteristics, since it can function as a peptizing agent and protective body for the crystals, and can provide the essential features and ingredients that are necessary to impart increased light sensitivity to the grains. The speed, contrast and graininess of silver halide emulsions are determined mainly by the size and size distribution of the silver halide grains and by the response of the grains to chemical sensitization with certain combinations of sensitizing agents such as labile sulfur and gold compounds. By properly controlling the crystal size pattern and chemical sensitization, it is possible to prepare photographic emulsions having a wide variety of sensitometric characteristics and photographic applications.

Crystal growth in gelatin photographic emulsion systems is promoted through the use of high mixing temperatures (e.g. 70° C.), long silver nitrate addition times (e.g. 1 hour), minimum gelatin concentrations, silver halide solvents (e.g. large halide ion excess, or ammonium hydroxide); and is retarded when the crystals are formed in the presence of certain bivalent cations (e.g. Cd++) or restraining bodies (e.g. nucleic acids) naturally present in gelatin. It is relatively easy to prepare gelatin photographic emulsions with a broad distribution of crystal sizes, but is is more difficult to obtain a narrow distribution of sizes (in the absence of solvents such as ammonium hydroxide), especially when large crystal sizes (i.e. average diameters larger than 1 $\mu$m) are desired. Commercially available polymers, which have been suggested as gelatin substitute materials, have not been wholly satisfactory for crystal growth control. In most cases the materials are not effective peptizing agents, and do not prevent the clumping or aggregation of crystals. Polymers, such as polyvinyl alcohol, polyacrylamide, or polyvinylpyrrolidone inhibit the growth of the grains to such an extent that it is not possible to obtain silver halide crystals of sufficient size to permit the attainment of the desired sensitometric characteristics. Accordingly, there is a need in the art for a gelatin substitute that will make possible control over crystal size and crystal size distribution.

There is also a need in the art for a synthetic gelatin substitute that can be produced on a consistent basis with respect to its physical, chemical and photographic properties, since gelatin is a natural product and hence often varies from batch to batch as regards its properties.

It is thus an object of the present invention to provide a photographic silver halide emulsion based on a synthetic binder for the silver halide grains.

It is also an object of the invention to prepare a photographic silver halide emulsion with control over the crystal size and crystal size distribution of the silver halide grains.

These and other objects are fulfilled by the present invention, which provides a photographic emulsion of silver halide in a water-soluble, film-forming amphoteric copolymer having in its molecule repeating units of the general formula:

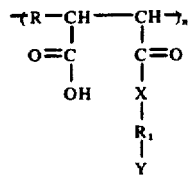

(1)

where $n$ is a positive integer, such as from 20 to 5000;

R is the residue of an ethylenically unsaturated organic monomer;

X is

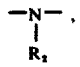

—S— or —O—, where $R_2$ is hydrogen or lower alkyl;

$R_1$ is lower alkylene, lower alkylene substituted by halogen, alkoxy or carboxy, cycloalkylene of 3 to 8 carbon atoms, or phenylene; and Y is

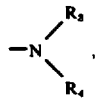

where $R_3$ and $R_4$ are even hydrogen, lower alkyl of lower alkyl substituted by amino, or $R_3$ and $R_4$ together with the nitrogen atom to which they are attached form a 3- to 8-membered saturated or unsaturated heterocyclic ring containing the nitrogen atom as the sole hetero atom or containing a second hetero atom selected from nitrogen, oxygen or sulfur,

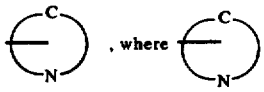

, where represents a 3- to 8-membered saturated or unsaturated heterocyclic ring containing the nitrogen atom in the ring as the sole hetero atom or containing a second hetero atom selected from nitrogen, oxygen or sulfur,

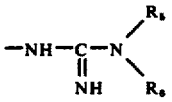

where $R_5$ and $R_6$ are each hydrogen or lower alkly,

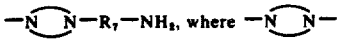

represents a 3- to 8- membered saturated or unsaturated heterocyclic ring containing the two nitrogen atoms as the sole hetero-atoms and $R_7$ is lower alkylene, or $—SR_8$, where $R_8$ is hydrogen or lower alkyl;

or, when X is as defined above and Y is

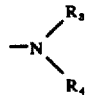

or $—SR_8$, $R_1$ represents the atoms necessary to form a 3- to 8-membered saturated or unsaturated heterocyclic ring with X and Y and containing X and Y as the sole hetero atoms;

and the quaternary ammonium salts thereof when Y is

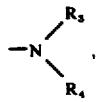

where $R_3$ and $R_4$ are lower alkyl or the ternary sulfonium salts thereof when Y is $—S—R_8$, where $R_8$ is lower alkyl. The quaternary ammonium or ternary sulfonium salts may be represented by the following formulas:

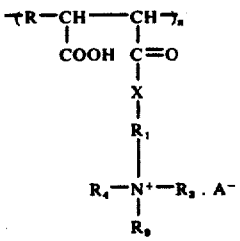

(Ia)

or

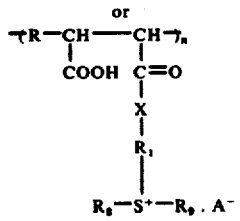

(Ib)

where R, $R_1$, X and n are as defined above, $R_3$, $R_4$ and $R_8$ are lower alkyl, $R_9$ is an aliphatic radical, such as alkyl, preferably lower alkyl, and A is an anion, such as a halide, sulfate, sulfonate, phosphate, hydroxide, nitrate, acetate, paratoluene sulfonate, or any other organic or inorganic anion that is photographically acceptable.

As used herein the terms "loweralkyl" and "lower alkylene" are intended to include a straight or branched hydrocarbon chain of 1 to 6 carbon atoms.

Figure 4:
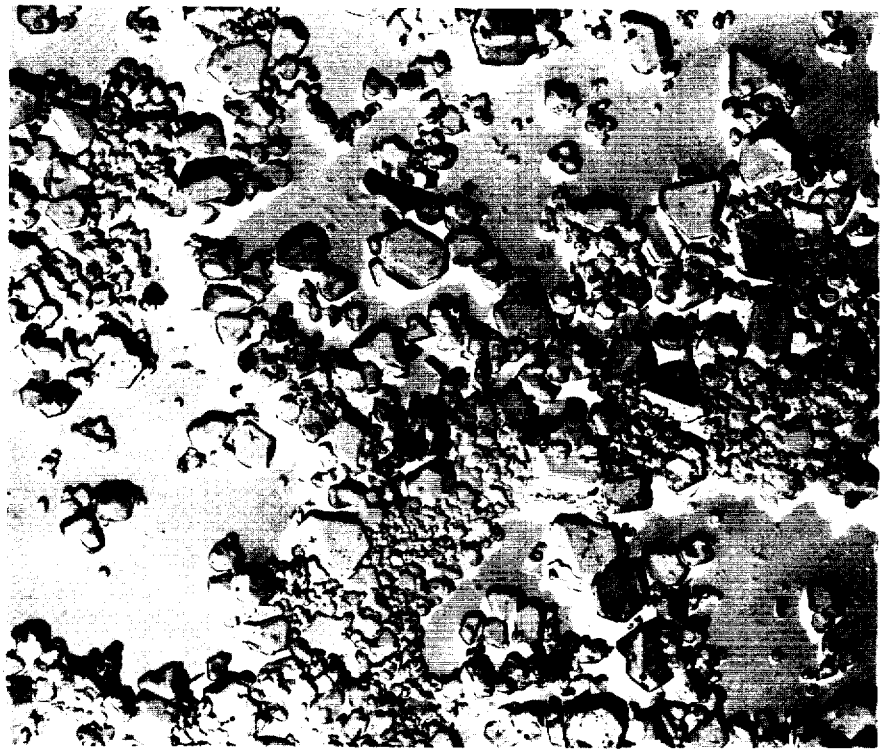
Figure 5:
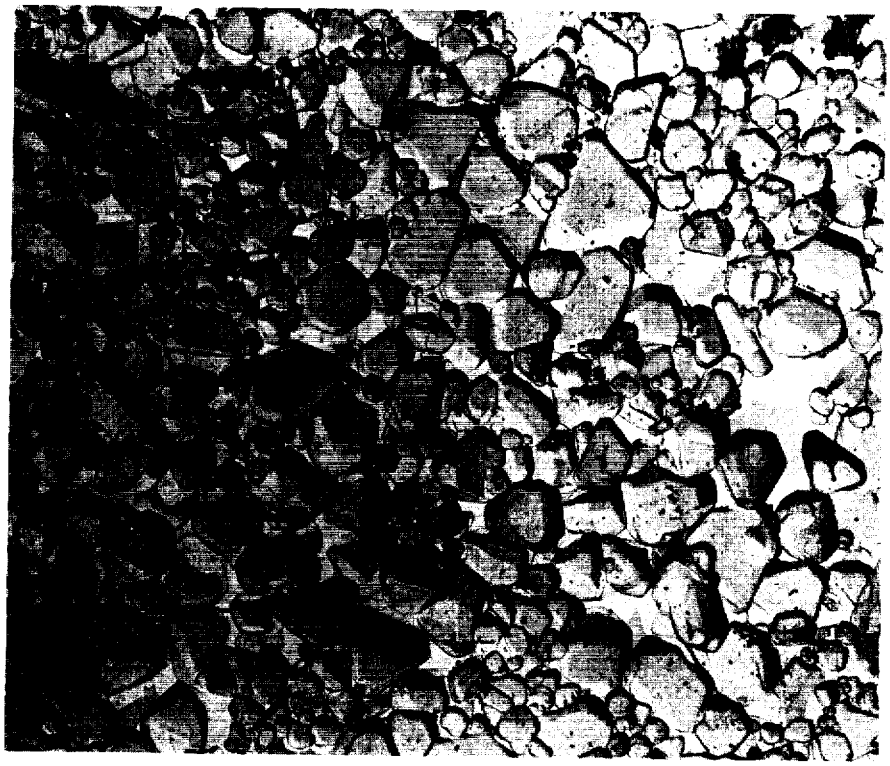
Figure 6:
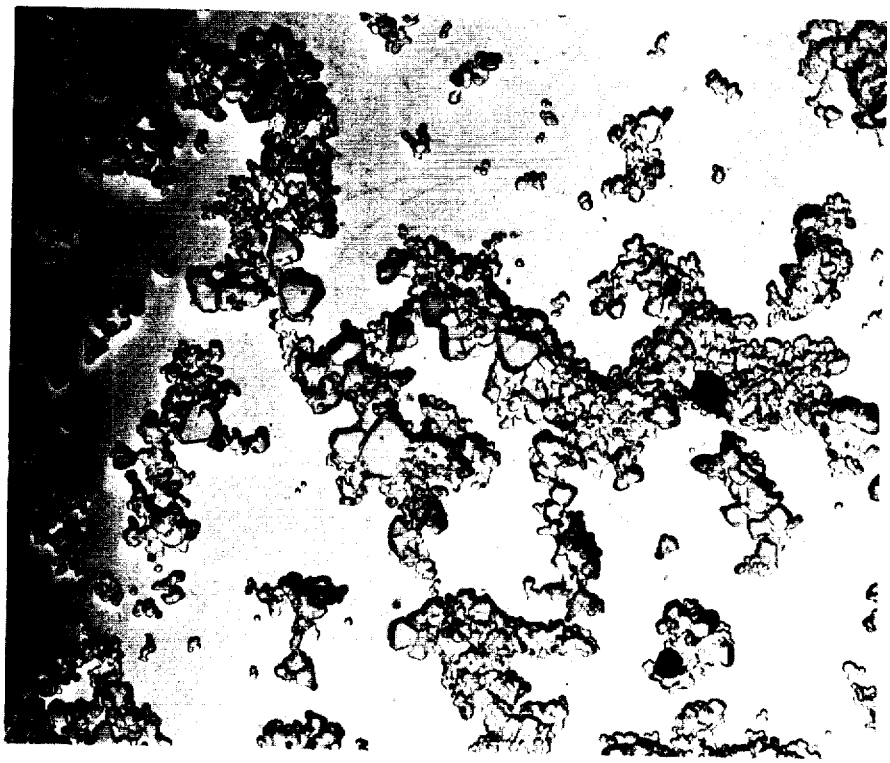
Figure 7:
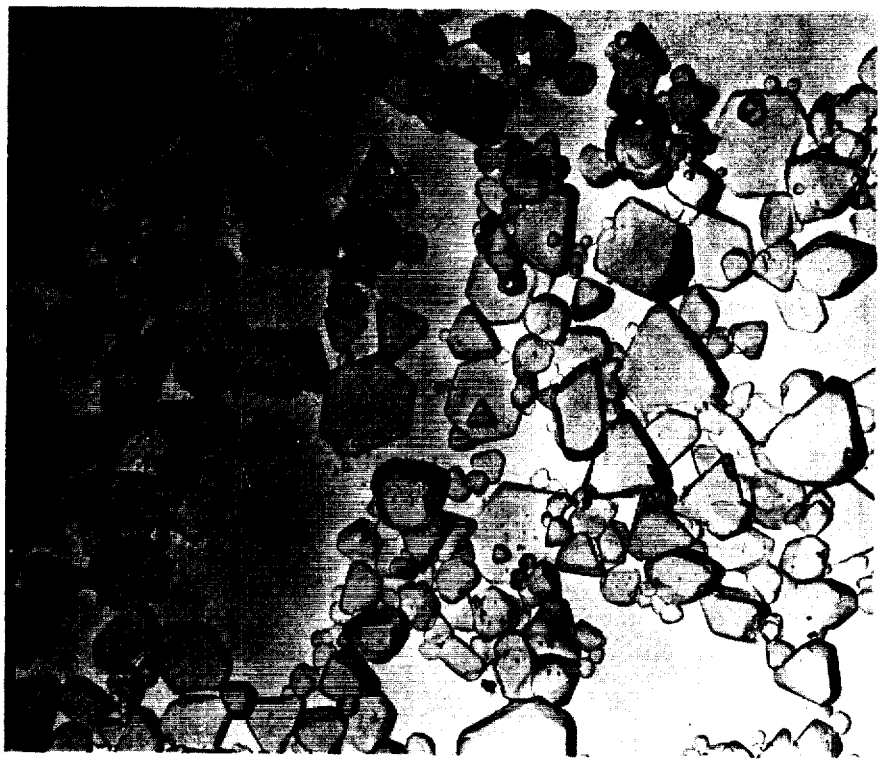
Figure 8:
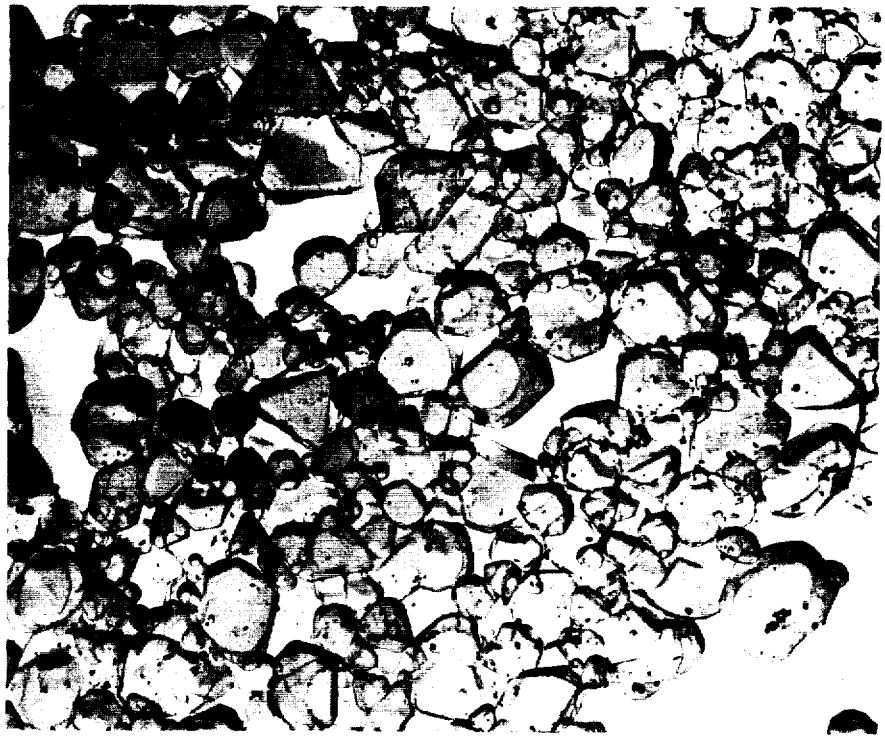
Figure 9:
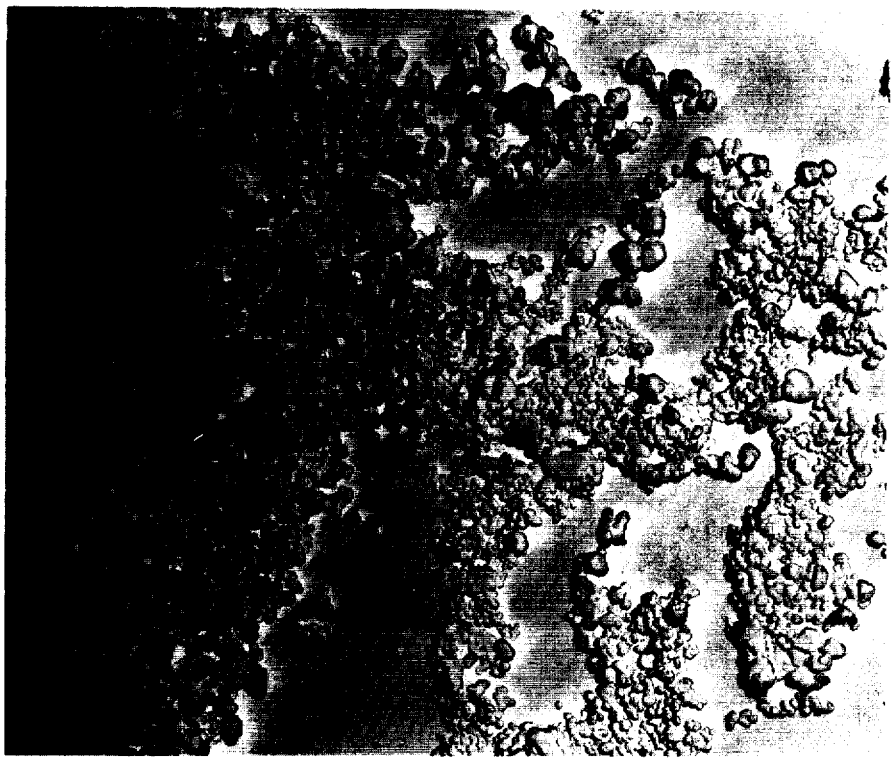
Figure 10:
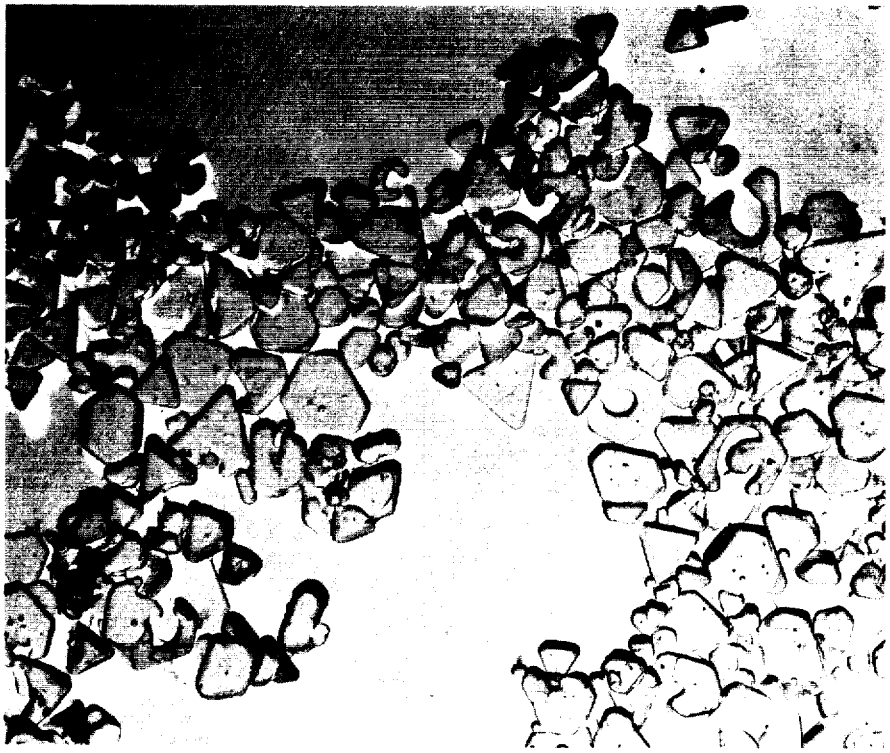
Figure 11:
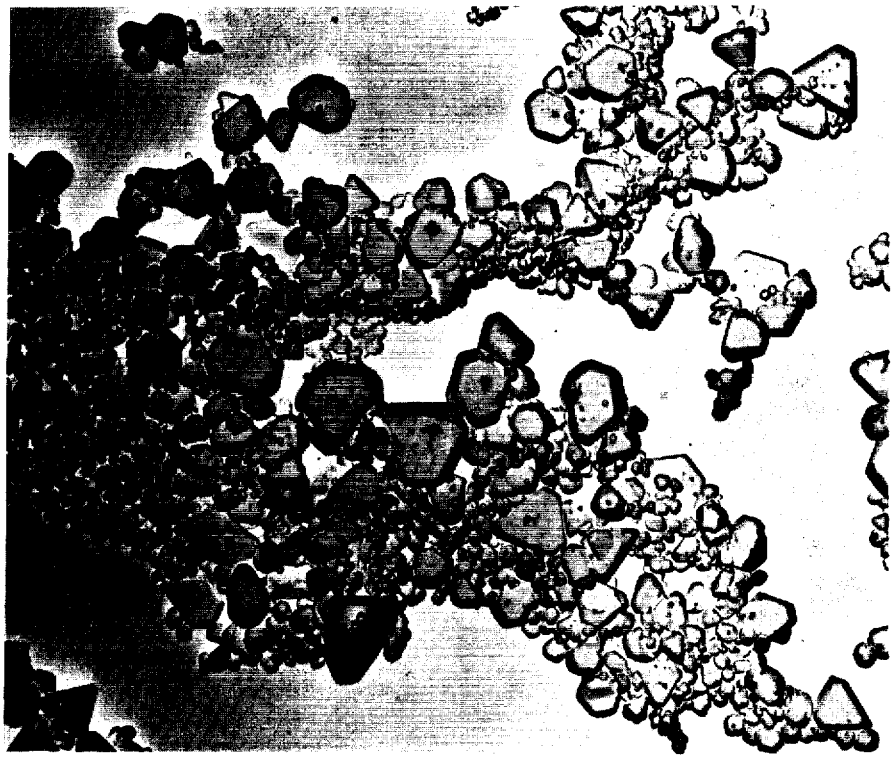
Figure 12:
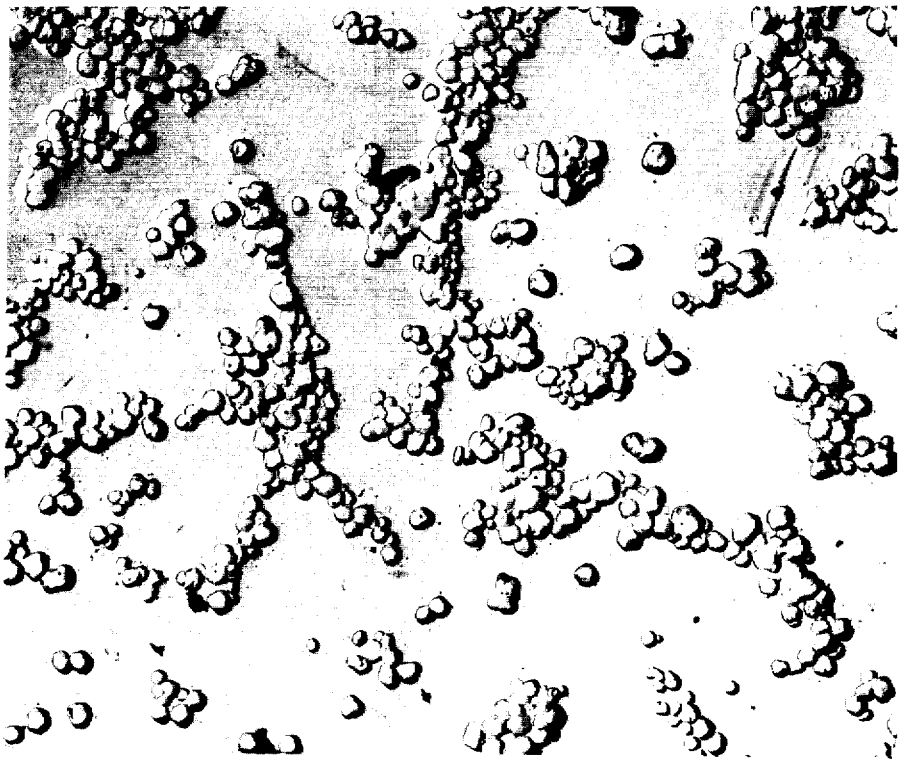
Figure 13:
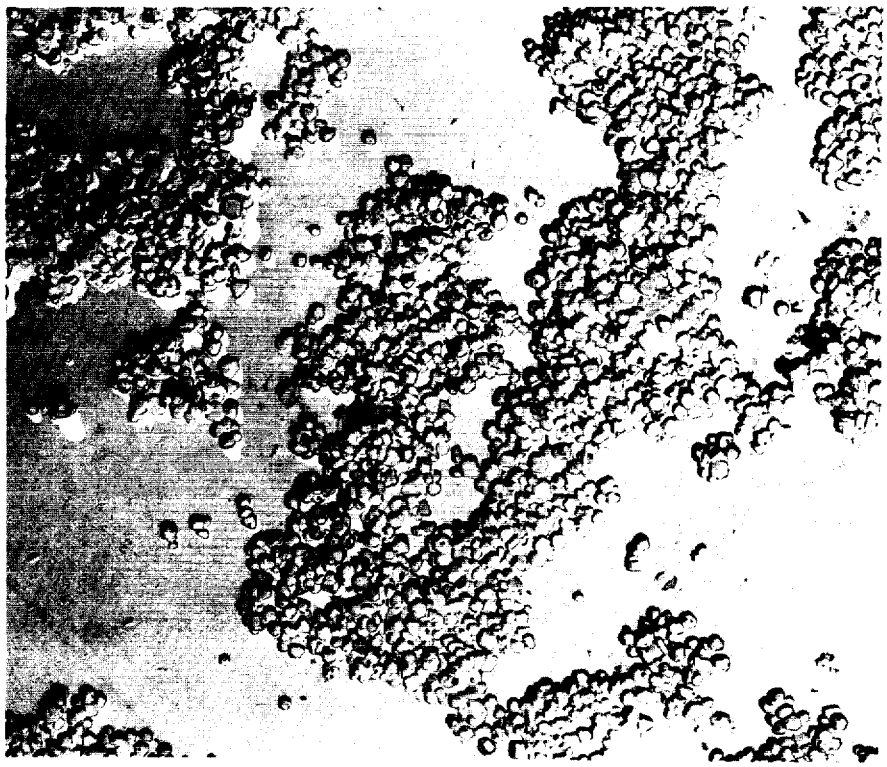
Figure 14:
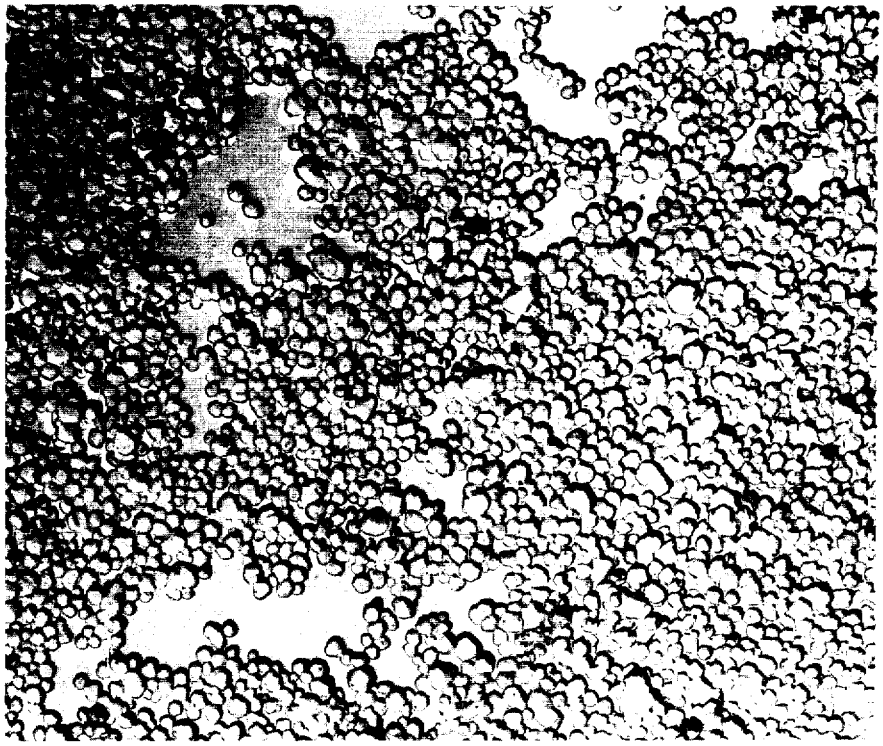
Figure 15:
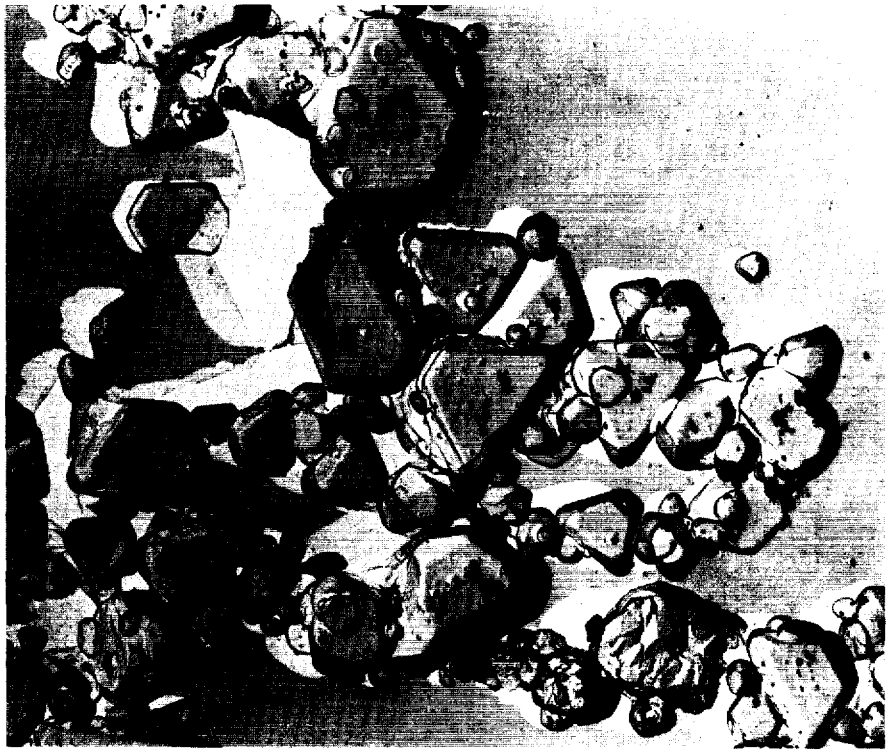
Figure 16:
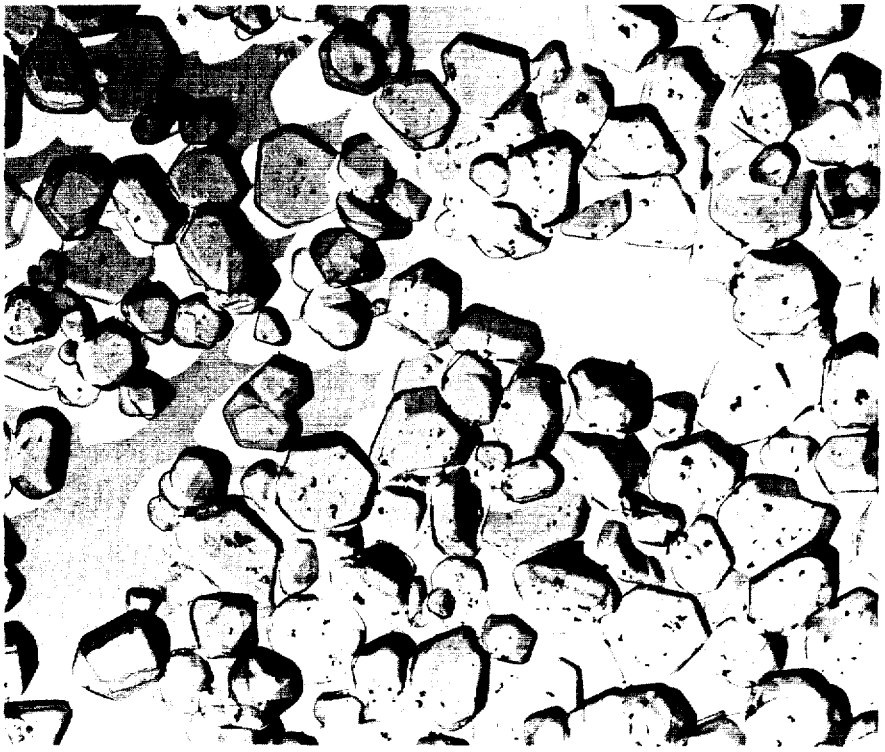
Figure 17:
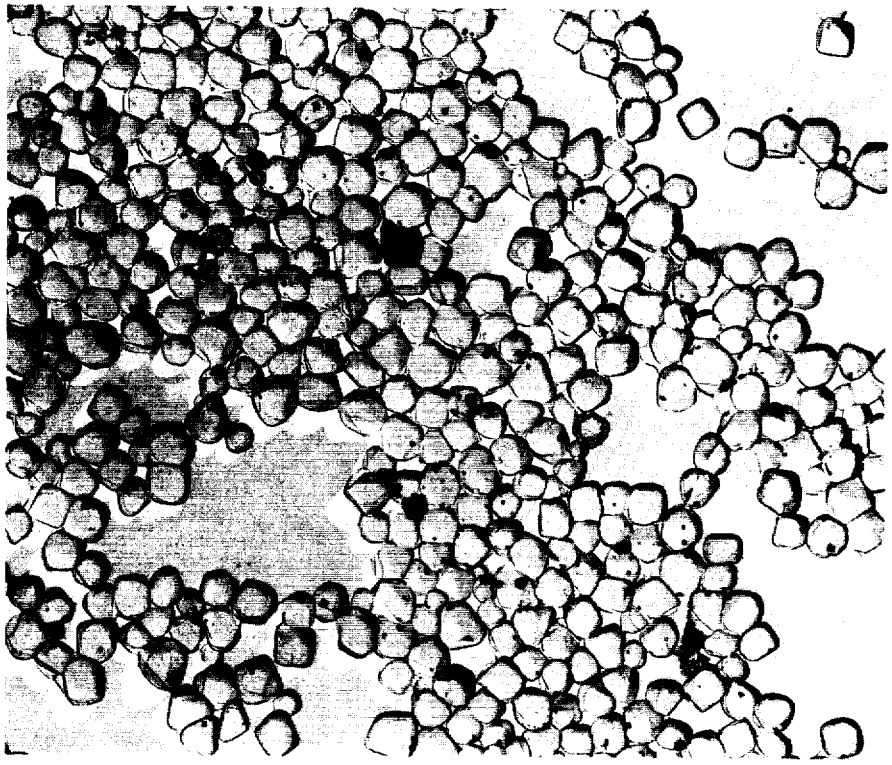
Figure 18:
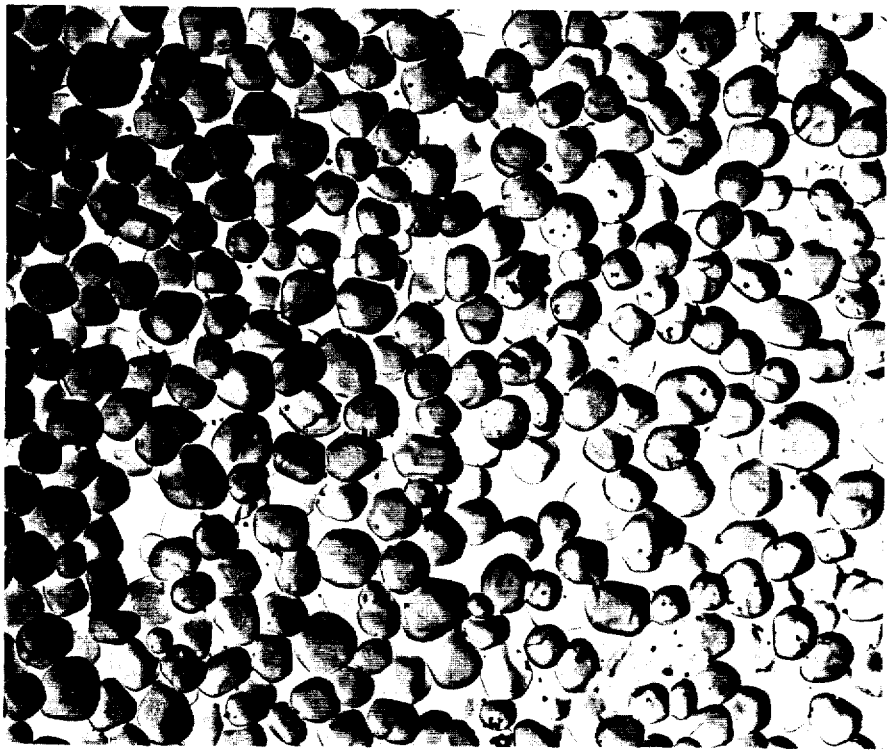
Figure 19:
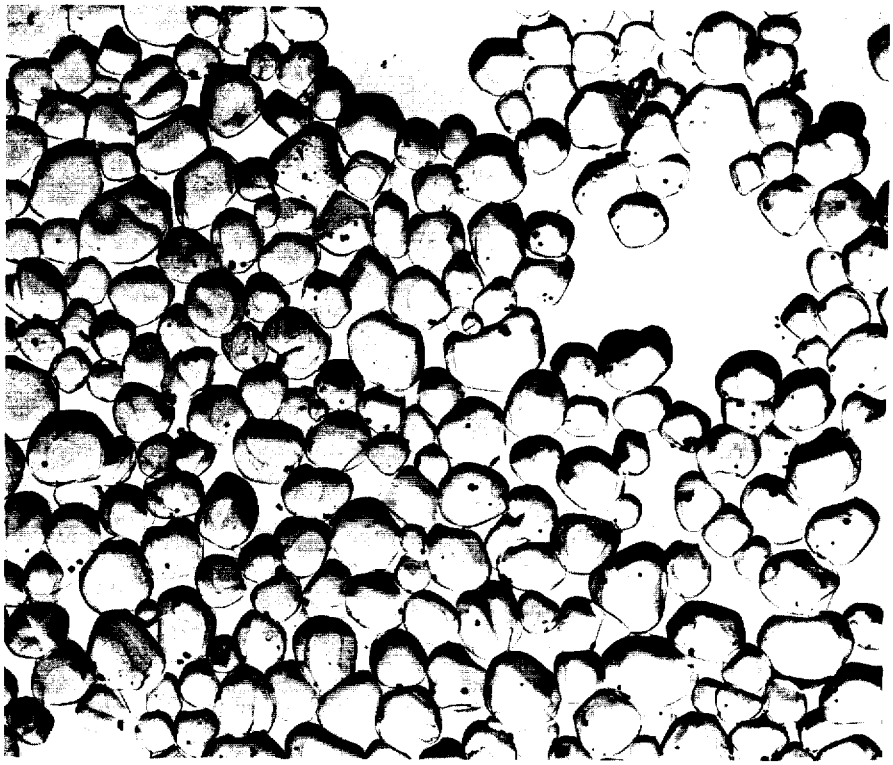
Figure 20:
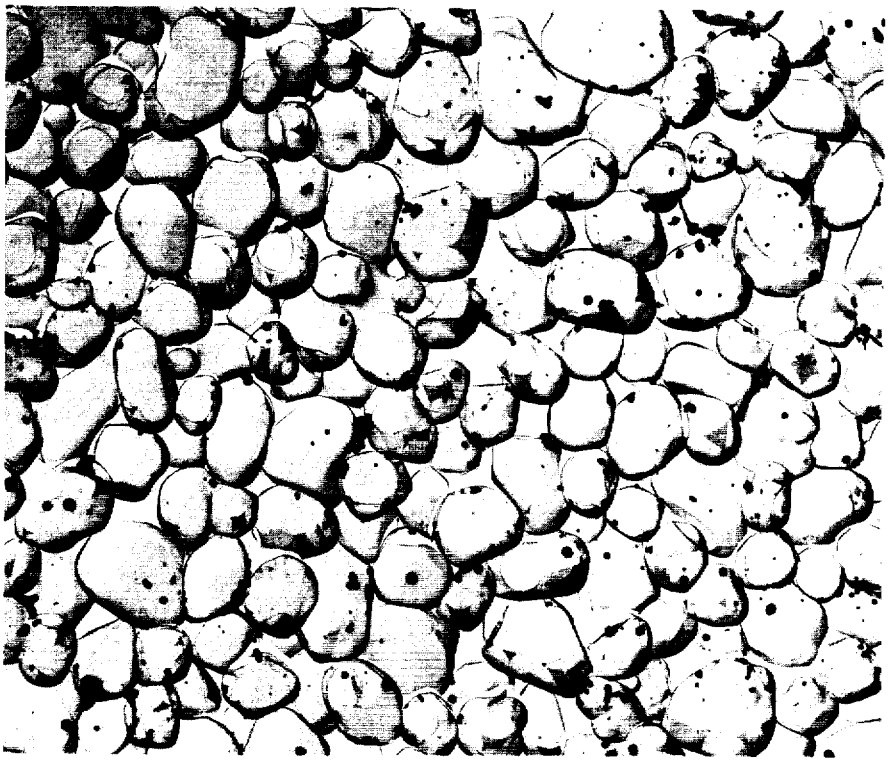
Figure 21:
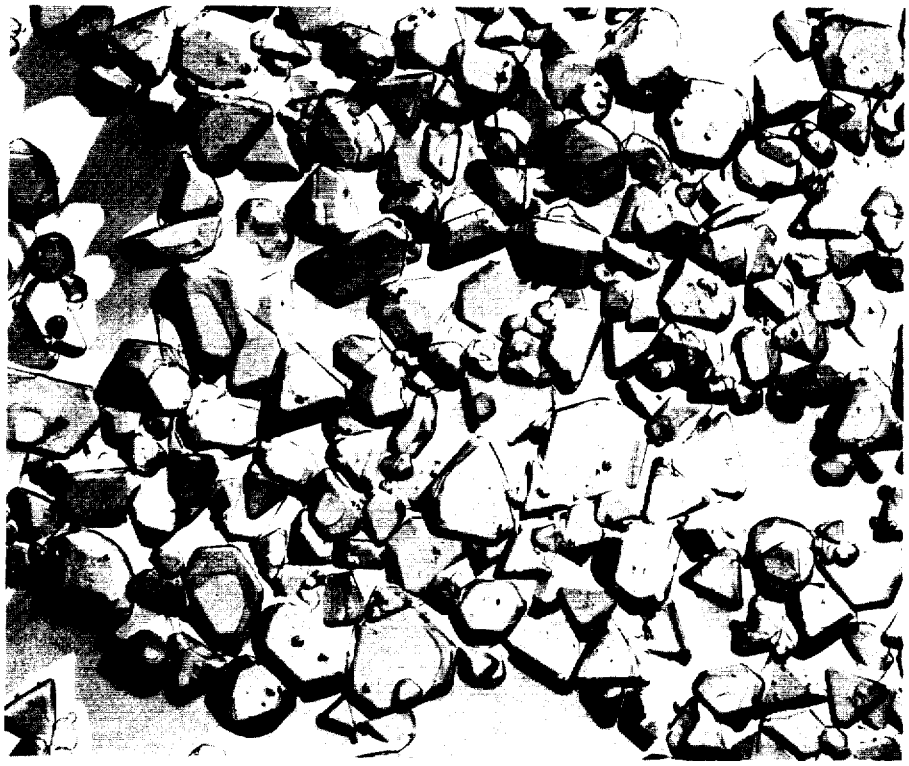
Figure 22:
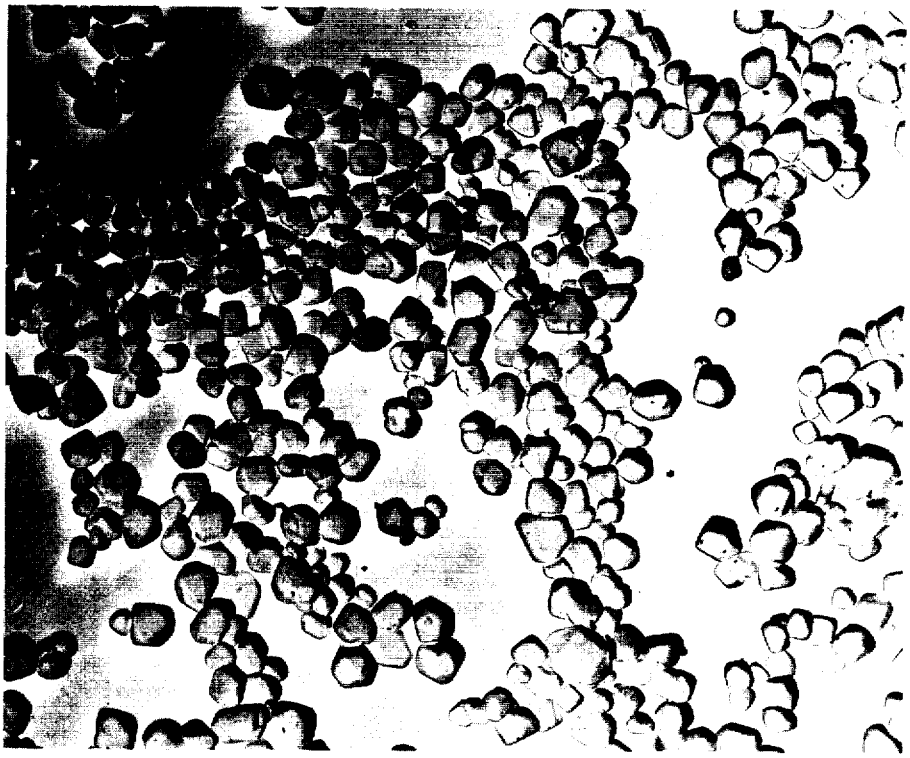
Figure 23:
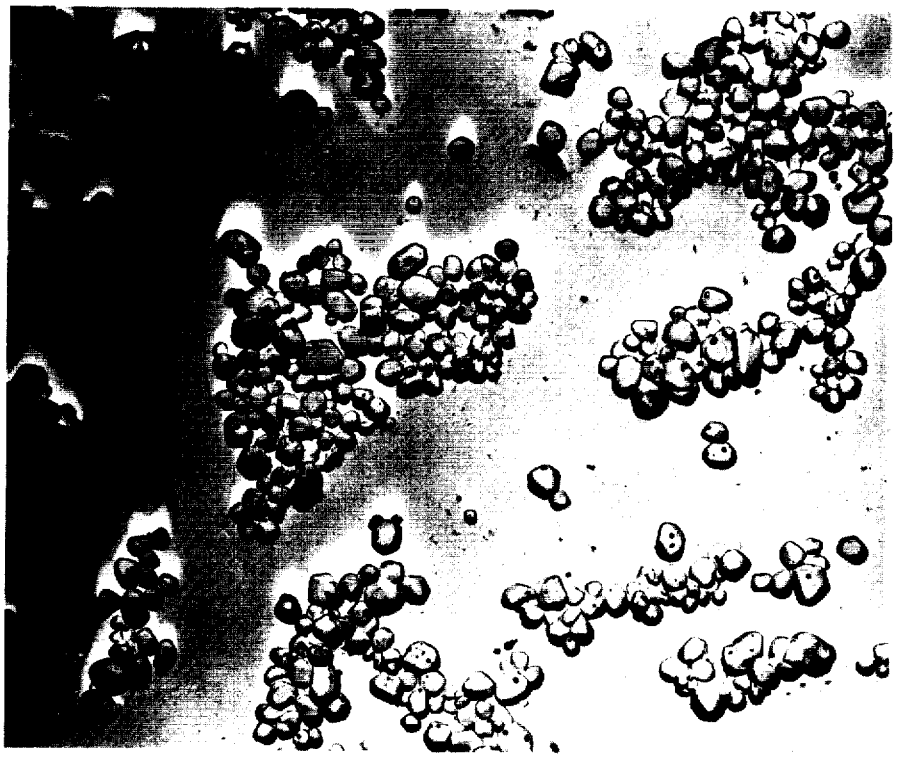
Figure 24:
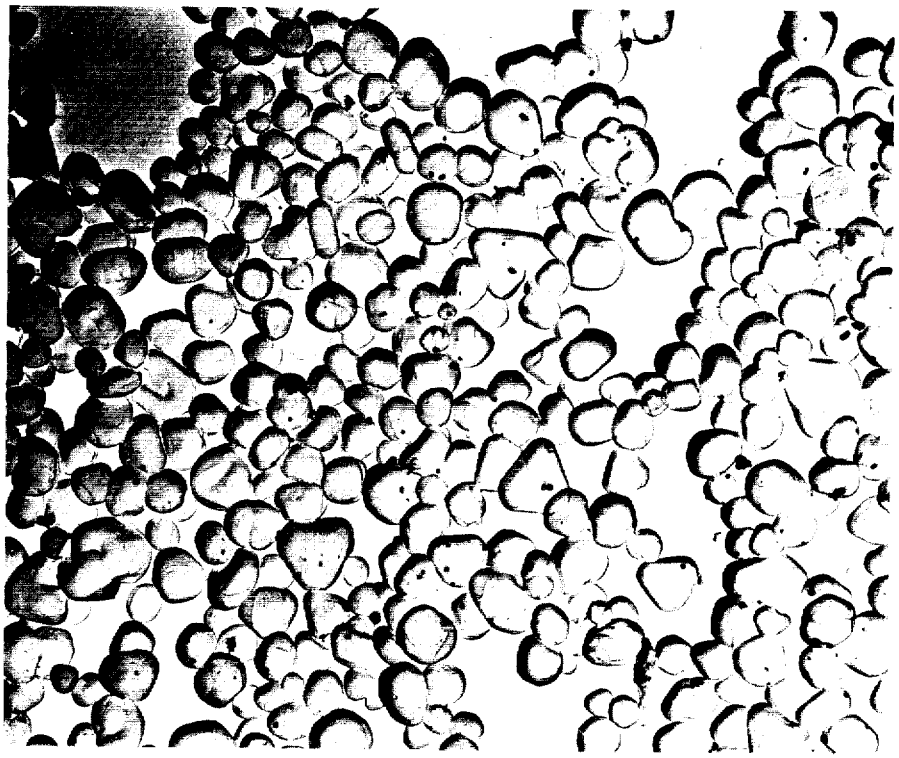
Figure 25:
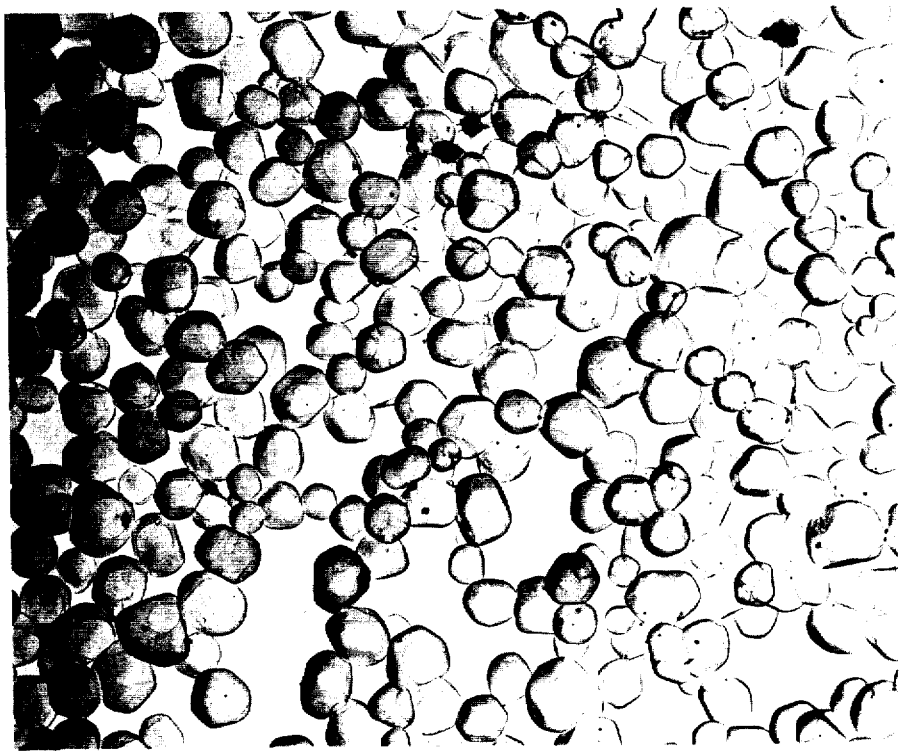
Figure 26:
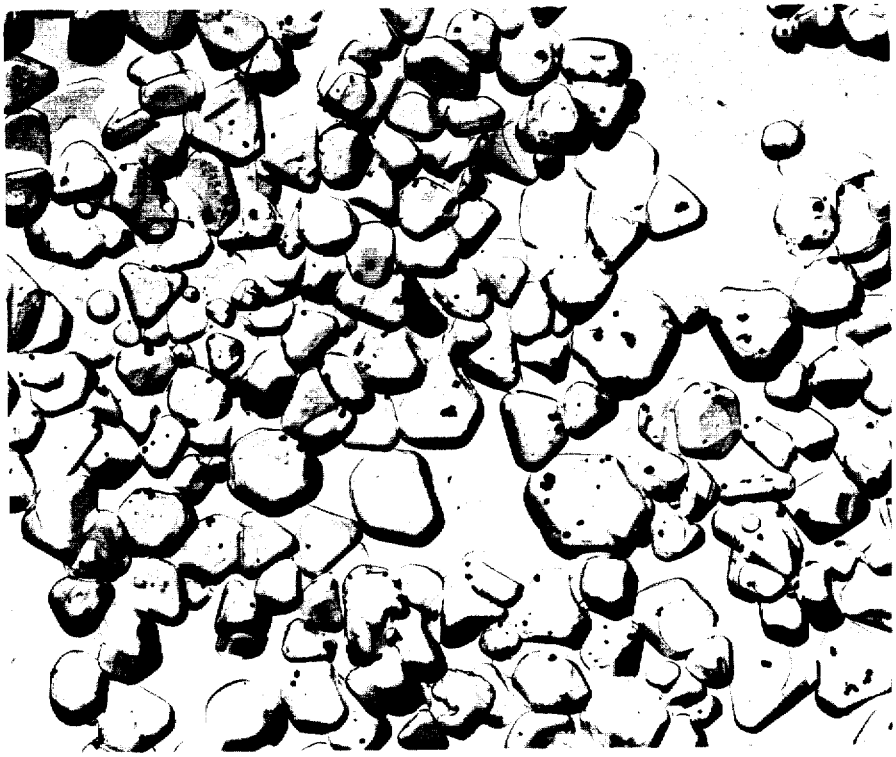
Figure 27:
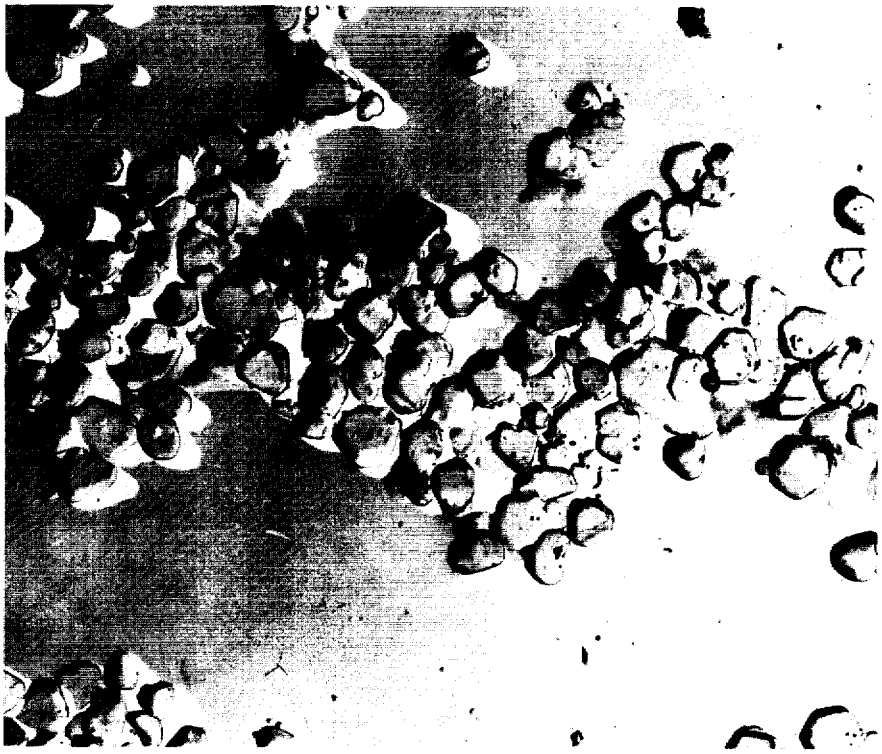
Figure 28:
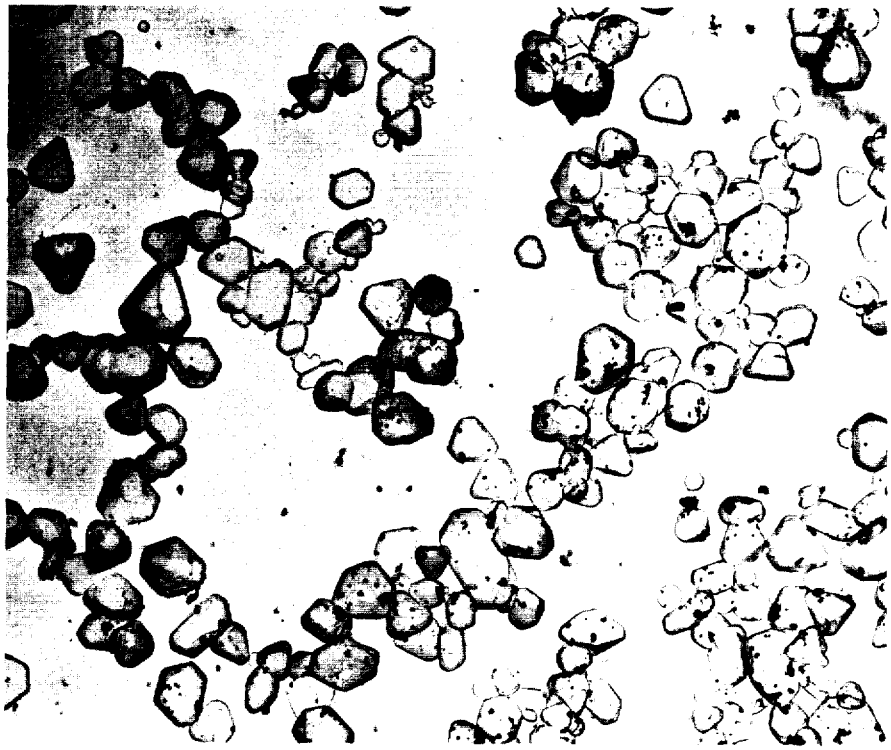
Figure 29:
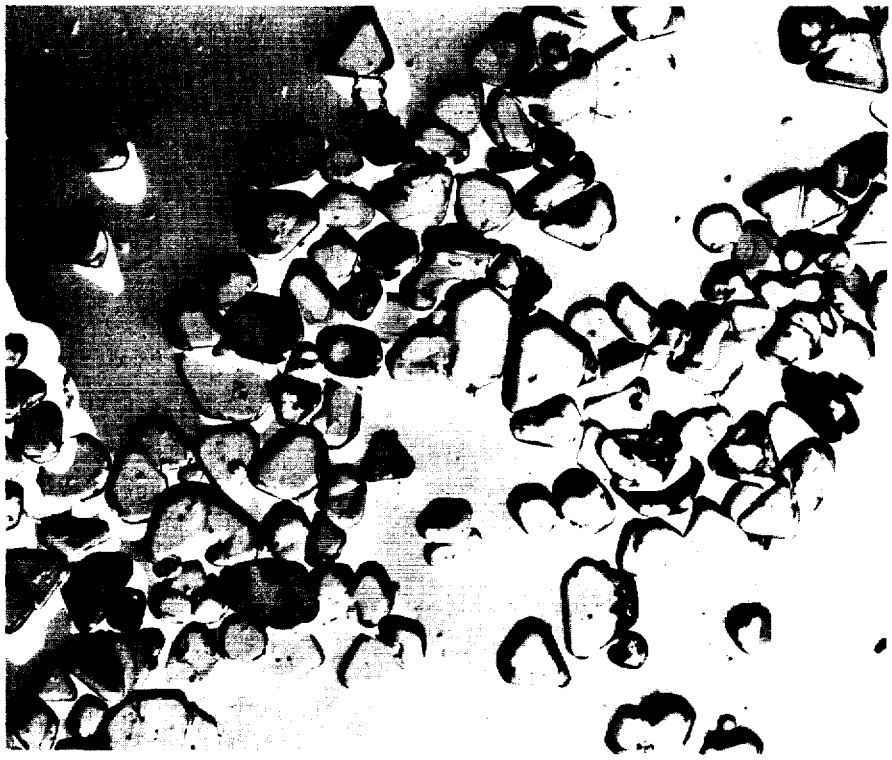
Figure 30:
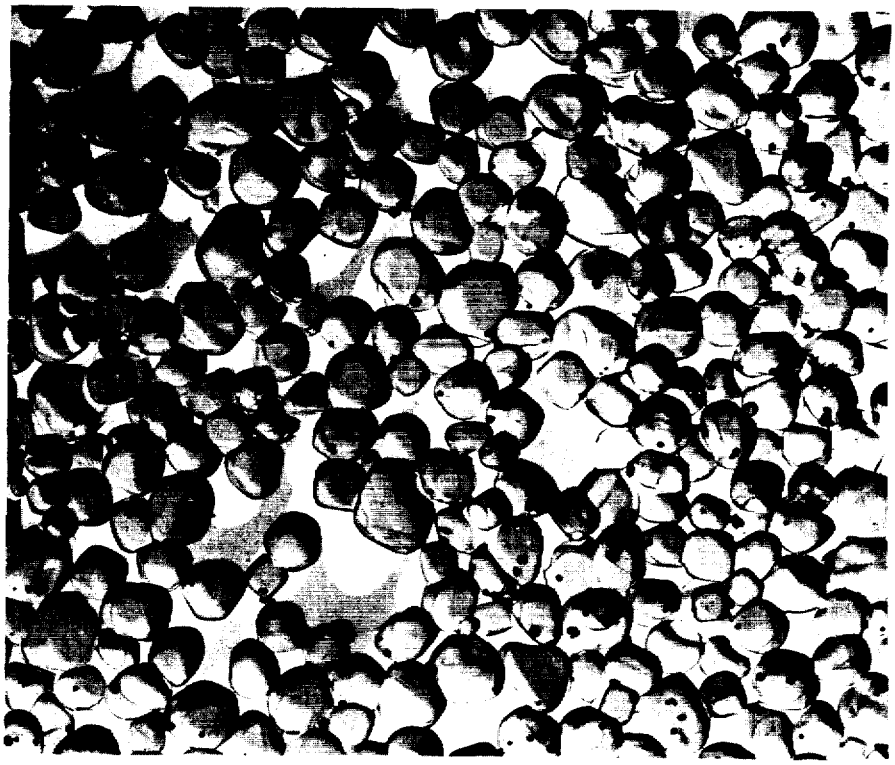
Figure 31:
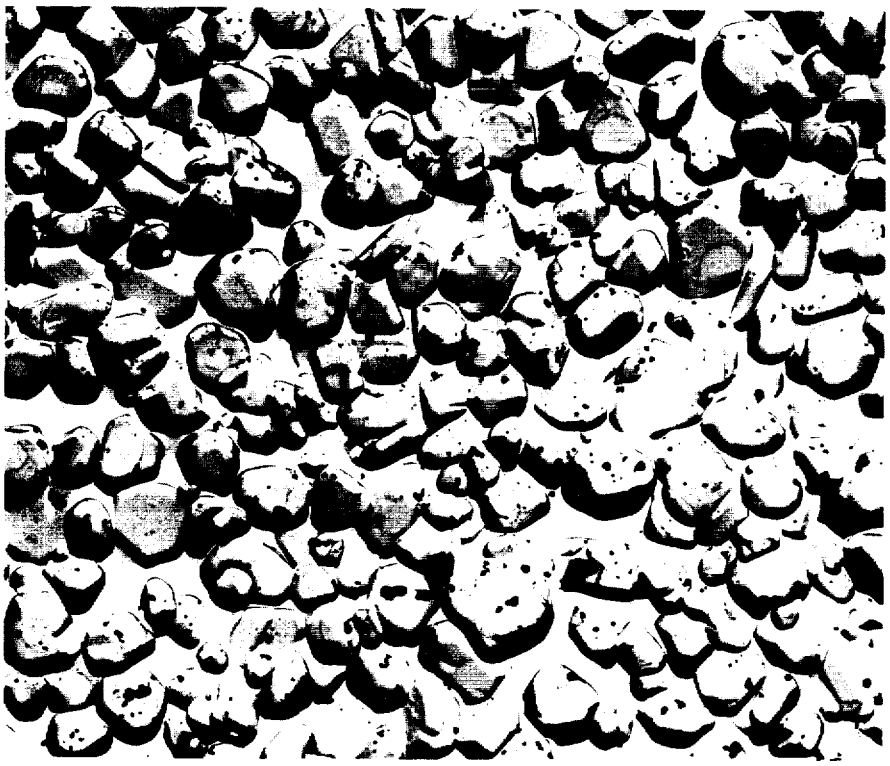

The present invention is illustrated by the accompanying drawings, in which:

FIGS. 1 to 31 are electron photomicrographs showing silver halide crystals in an amphoteric copolymer binder prepared according to Examples 12 to 42, respectively.

The amphoteric copolymers (I) of the present invention are water-soluble, film-forming copolymers formed by reaction of a bifunctional reactant (II), $H—X—R_1—Y$, where X, $R_1$ and Y are as defined above, and a copolymer (III) of maleic anhydride and an ethylenically unsaturated, copolymerizable monomer, such as an α-olefin, styrene, N-vinylpyrrolidone or an alkylvinylether. Maleic acid copolymers and their preparation are described in Voss et al U.S. Patent 2,047,398, issued July 14, 1936, Reissued as U.S. Pat. No. Re. 23,514 June 24, 1952. Some typical maleic acid copolymers (III) are as follows:

| Copolymer | Mol Ratio | Relative Viscosity in 1% Methyl Ethyl Ketone |
|---|---|---|
| n-butyl vinyl ether/maleic anhydride | 1:1 | 2.2 |
| n-butyl vinyl ether/maleic anhydride | 1:1 | 1.59 |
| Isobutyl vinyl ether/maleic anhydride | 1:1 | 3.93 |
| Isobutyl vinyl ether/maleic anhydride | 1:1 | 1.66 |
| Octadecyl vinyl ether/maleic anhydride | 1:1 | 1.91 |
| Isoctyl vinyl ether/maleic anhydride | 1:1 | 1.91 |
| Dodecyl vinyl ether/maleic anhydride | 1:1 | 1.52 |
| Cetyl vinyl ether/maleic anhydride | 1:1 | 1.20 |
| Styrene/maleic anhydride | 1:1 | 2.82 |
| Ethylene/maleic anhydride | 1.5:1 | 2.44 (1% in N-methyl-2-pyrrolidinone) |
| Vinyl pyrrolidinone/maleic anhydride | 1:1 | 1.16 (1% in $H_2O$) |

Copolymers of maleic anhydride and alkylvinylether of the formula:

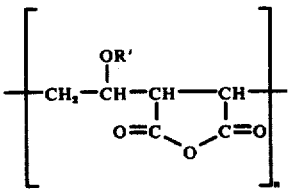

Wherein R' is lower alkyl, preferably methyl, and the symbol *n* represents a positive integer having a value of from 35 to 3500 are particularly useful. These copolymers generally have a molecular weight of from about 5000 to about 500,000 and a specific viscosity within the range 0.1 to 4 centistrokes, and preferably from 0.1 to 2 centistrokes (determined in a 1% methylethyl ketone solution), such as GANTREZ AN-119 (specific viscosity 0.1—0.5 centistokes), GANTREZ AN-139 (specific viscosity 1.0—1.4 centistokes), and GANTREZ AN-169 (specific viscosity 2.6—3.5), all made by GAF Corporation, New York, New York. GANTREZ is a registered trademark of GAF Corporation.

The amphoteric copolymer (I) is formed by reaction of the bifunctional reactant (II) and the maleic anhydride copolymer (III) as follows:

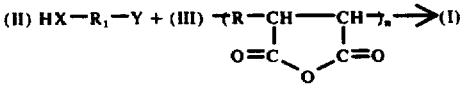

where R, $R_1$, X, Y and *n* are as defined above. The reaction between the bifunctional reactant (II) and the maleic anhydride copolymer (III) readily takes place in a organic solvent at elevated temperature, e.g. from 40° C. to reflux, and no special conditions are required. Where the group Y in the amphoteric copolymer (I) is a primary amino group, e.g. when $Y = —NR_3R_4$ and $R_3$ and $R_4$ are each hydrogen, then the primary amino group Y in the bifunctional reactant (II) must be protected by a suitable protecting group to prevent reaction between the amino group Y and the maleic anhydride copolymer (III).

Suitable bifunctional reactants, $HX—R_1—Y$, include:

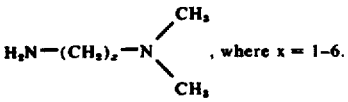
, where x = 1–6.

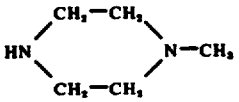

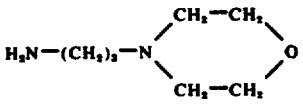

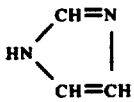

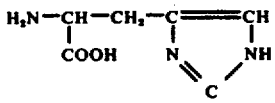

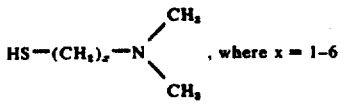
, where x = 1–6

$H_2N—(CH_2)_x—S—CH_3$, where x = 1–6

$HS—(CH_2)_x—S—CH_3$, where x = 1–6

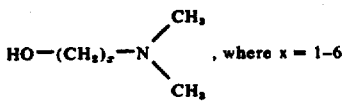
, where x = 1–6

$HO—(CH_2)_x—S—CH_3$, where x = 1–6

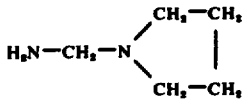

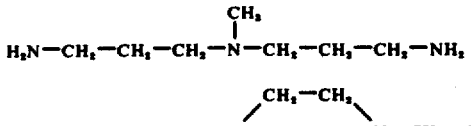

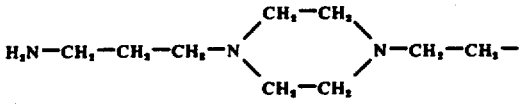

$—CH_2—NH_2$

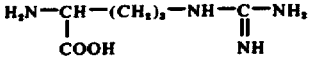

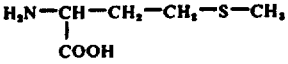

The quaternary ammonium or ternary sulfonium salts of the amphoteric copolymer (I) may be readily formed in those cases where Y in Formula (I) is

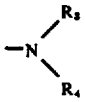

or $S—R_8$, and $R_3$, $R_4$ and $R_8$ are lower alkyl, by treatment of the amphoteric copolymer (I) with a suitable alkylating agent, such as a lower alkyl halide, a haloacetic acid, methyl-p-toluenesulfonate and the like. In such cases, the amphoteric copolymer is reacted with the alkylating agent in a suitable solvent, such as dimethylformamide at an elevated temperature, e.g. from 50° –100° C.

When the amphoteric copolymer is formed from a bifunctional reactant (II) that has a primary amino functionality, e.g. when X = —NH—, it is possible that in addition to the amphoteric copolymer (I) the cyclic imide (Ic) below may also be produced as a secondary reaction product:

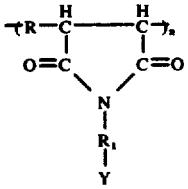
(Ic)

Accordingly, it is preferred that the bifunctional reactants have a secondary amino group, HX—, such as N-methyl piperazine. Such a compound cannot form an imide structure and therefore gives a more precise control over the cationic to anionic functional group ratio during the synthesis.

Photographic silver halide emulsions may be prepared according to the present invention by the basic technique of peptization and growth of silver halide grains from the reaction between a water-soluble alkali metal halide or mixture of alkali metal halides and a water-soluble silver salt, e.g. silver nitrate, in an aqueous solution of the copolymer (I) of the invention or an aqueous solution of the copolymer (I) and gelatin or a modified gelatin, such as a phthalyl derivative, with agitation over a period of from about 1 minute to about 2 hours at a temperature of from about 30° to about 90° C. preferably about 50° to about 70° C. The liquid emulsion thus formed is precipitated with an inorganic salt, as is used in gelatin emulsions, such as with ammonium sulfate or surface active or polymeric sulfates and sulfonates, followed by acidification to a pH value below the isoelectric point of the copolymer or copolymer/gelatin or modified gelatin vehicle. After washing to a predetermined low conductivity and a predetermined pAg value, the concentrate thus formed may be reconstituted with gelatin, a modified gelatin and/or a gelatin-compatible substitute, such as zein, albumin, cellulose derivatives, polysaccharides, such as dextran, gum arabic and the like, or with such synthetic polymers as polyvinylalcohol, acrylamide polymers, polyvinylphrrolidone and the like, and the emulsion thus formed is suitable for final treatment before coating on a suitable base.

The emulsions may be chemically sensitized with labile sulfur compounds, such as sodium thiosulfate or thiourea; with reducing agents, such as stannous chloride; with salts of noble metals, such as gold, palladium and platinum; or combinations of these.

The emulsions may also be optically sensitized, such as with cyanine and merocyanine dyes. Where desired, suitable antifoggants, toners, restrainers, developers, development accelerators, preservatives, coating aids, plasticizers, hardeners and/or stabilizers may be included in the composition of the emulsion.

The emulsions of this invention may be coated and processed according to conventional procedures of the art. They may be coated, for example, onto various types of rigid or flexible supports, such as glass, paper, metal, and polymeric films of both the synthetic type and those derived naturally occurring products. As examples of specific materials which may serve as supports, mention may be made of paper, aluminum, polyvinyl acetal, polyamides such as nylon, polyesters such as polymeric film derived from ethylene glycol-terephthalic acid, polystyrene, polycarbonate, and cellulose derivatives such as cellulose acetate, triacetate, nitrate, propionate, butyrate, acetate propionate, and acetate butyrate. These novel emulsions of the instant invention have been found to adhere to supports in a most satisfactory manner.

As can be seen from the above,the peptization, crystal growth and sensitization of the silver halide emulsion is carried out according to conventional technology, and optimum conditions will be determind empirically by procedures well known to those working in this art. However, the use of the copolymer (I) in the emulsion does influence the properties of the final emulsion, and hence emulsions can be tailor-made by control of various parameters relating to the copolymer (I).

Thus, excellent silver halide peptization and crystal growth is obtained when the molar ratio of bifunctional reactant (II) to the maleic anhydride residues in the copolymer is within the range of from about 1:1 to about 1:4. Stated in other terms, the molar ratio of cationic groups to anionic groups in the amphoteric copolymer (I) is from about 1:1 to about 1:4. In general, it has been observed that a substantially equimolar ratio of cationic to anionic groups in the copolymer, such as from about 1:1 to about 1:1.1, improves the degree of peptization of the grains, favors the formation of small crystal sizes and a narrow distribution of those sizes, and increases the rate of chemical sensitization. When the proportion of anionic groups is larger, e.g. at a molar ratio of cationic to anionic groups in the copolymer of from about 1:1.2 to about 1:1.5, the growth of larger crystal sizes of a wider size distribution is promoted, which produces photographic emulsions with higher speeds and lower contrasts. If the proportion of anionic groups becomes too large, e.g. at molar ratios of cationic to anionic groups of 1:>4, the crystals are incompletely peptized, the response to chemical sensitization is poor, and the fog levels, (especially internal) are high.

Further control over the molar ratio of cationic to anionic groups may be effected by adding to the copolymer (I) a surface-active cationic agent having an aliphatic chain of 8 to 18 carbon atoms, as described in Sprung U.S. Pat. No. 3,113,026, issued Dec. 3, 1963. The disclosure in this patent relating to the use of surface-active cationic agents, and particularly Table 1 thereof, is incorporated herein by reference thereto. In the present invention, the surface-active cationic agent, when use, is employed in an amount of up to about 5% by weight, based on the copolymer (I). Any of the surface-active agents described in the Sprung Patent may be used, but of special interest are the compounds which contain guanyl, guanido, and biguanido functional groups, e.g. structures C-27 through C-37 in Table I of the Sprung Patent, and those containing quaternary ammonium plus one or more carboxamide or sulfonamide groups. It is to be noted that many of the long chain surface-active compounds containing guanido, biguanido or quaternary ammonium groups, etc., may have adverse effects, i.e. produce undesirable crystal growth patterns or cause desensitization or fog when added alone to photographic emulsions. However, when used judiciously in combination with the amphoteric copolymer (I) of this invention, they function as cationic/anionic control agents. This beneficial behavior, as explaind in U.S. Pat. No. 3,113,026, is probably due to the fact that they can form insoluble salts (U.S. Pat. No. 2,704,710) with the anionic groups in the amphoteric copolymer (I) or gelatin and can shift the inner salt or zwitterion equilibrium to produce a slightly higher cationic to anionic ratio in the amphoteric copolymer (I) and/or gelatin layer that is adsorbed on the silver halide grain surface.

The amount of the copolymer (I) required for silver halide peptization and grain growth purposes will be empirically determined, but generally amounts within the range of from about 1.0 to about 70 grams per mol of silver halide will be satisfactory. If too little of the copolymer (I) is employed, there is a tendancy for the silver halide grains to be incompletely dispersed, and the coated, exposed and developed emulsions exhibit a peppered appearance. An excessively high concentration of the copolymer (I) may make it difficult to precipitate or coagulate and wash the emulsion adequately. When these problems are encountered, it is a simple matter to alter the proportion of copolymer to give satisfactory results.

Gelatin may be admixed with the amphoteric copolymer (I) before and/or after the peptization and grain growth stage. Since the copolymer is compatible with gelatin in all proportions, it is possible to use the copolymer (I) and gelatin in any ratio needed to obtain the photographic characteristics desired. The major consideration would be that at the higher concentration levels of either copolymer or gelatin, physical problems may be encountered in the precipitation and the subsequent washing of the emulsion. As an example of the wide range of gelatin that can be used with the copolymer (I), an amount of up to 2500%, such as from about 2.5 to about 2500% of gelatin, based on the weight of the copolymer (I), can be used, either during the peptization and grain growth stage or thereafter.

The present invention is illustrated by the following Examples. In the specification and appended claims, all parts and proportions are by weight unless otherwise noted.

EXAMPLE 1

Preparation of:

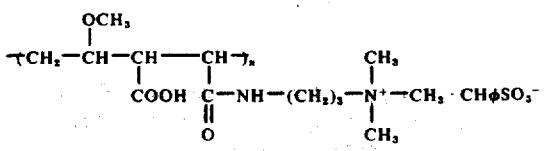

A stirred mixture of 15.6g (0.1 mol) of methylvinylether-maleic anhydride copolymer (GANTREZ AN-119) and 40.8g (0.4 mol) of 3-dimethylaminopropylamine in 82 ml dry benzene was heated at 50—55° C. for 4 hours and at 80° C. for ½ hour. The mixture was cooled, and the solid material was removed by filitration and washed with benzene. The filter cake was triturated with anhydrous diethylether, removed by filtration, and dried in a vacuum desiccator. Yield = 32.5g The polymer was purified (i.e. freed from the 3-dimethylaminopropylamine salt which is partially formed as a secondary reaction) by dissolving it in water and passing it through a column charged with Dowex 50W-XB ion exchange resin. The aqueous solution of the polymer was evaported to dryness under reduced pressure.

A solution of 6.3g of the above purified polymer and4.7g of methyl p-toluenesulfonate in 25 ml dimethylformamide was heated on a steam bath for 4 hours. The cooled solution was poured into diethylether, and the gummy precipitate, which formed, was triturated and washed by decantation with diethylether.

The vacuum dried quaternized polymer weighed 8.8g and had the structure set forth above.

EXAMPLE 2

Preparation of:

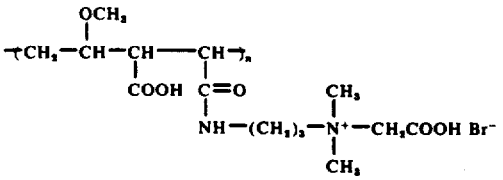

Following the procedure of Example 1, but using bromoacetic acid as the alkylating agent, there was produced the copolymer shown above.

EXAMPLE 3

Preparation of:

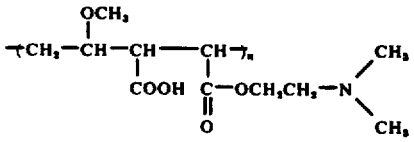

To a stirred solution of 35.6g (0.4 mol) of 2-dimethylaminoethanol in 750 ml acetone, there was slowly added a solution of 63g (0.4 mol) of methylvinylether-maleic anhydride copolymer (GANTREZ AN-119) in 750 ml acetone at the reflux temperature of acetone. Five drops of concentrated sulfuric acid was added, and the whole was heated under reflux for approximately 12 hours. The precipitated material was removed by filtration, and washed with acetone. The amphoteric polymer shown above was recovered in a yield of 98.6g.

EXAMPLE 4

Preparation of:

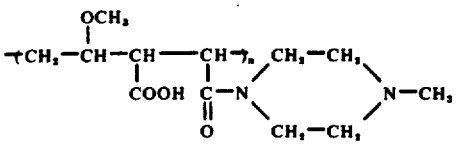

In a 2-liter flask, equipped with a mechanical stirrer, reflux condenser and dropping funnel, there was placed a solution of 27.2g (0.272 mols) of N-methylpiperazine in 600 ml of acetone. The solution was heated to reflux, and there was added through the dropping funnel, over a 20 min. period, a solution of 50g (0.32 mols) of methylvinylether-maleic anhydride copolymer GANTREZ AN-119) in 600 ml of acetone. The stirred mixture was heated under reflux for a period of 16 hours. The solid, which separated, was removed by filtration, and the filter cake was washed with acetone until the washings were free of yellow color. The air-dried material, which consisted of a mixture of the N-methylpiperazine salt of the free acid and the N-methylpiperazine carboxamide derivative of the methylvinylether-maleic acid copolymer shown above, weighed 77.2g.

EXAMPLE 5

Preparation of:

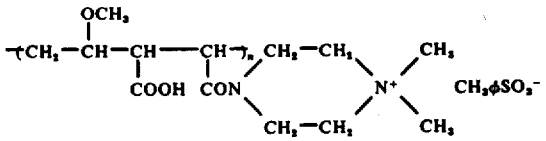

A mixture of 77.2g of the copolymer of Example 4 (containing approximately 0.272 moles of tertiary amino groups), 56g (0.3 mols) of methyl p-toluene sulfonate and 400 ml of dimethylformamide were placed in a 2-liter flask and heated (after an initial exothermic reaction), with stirring, at a temperature of 90°–95° C for a period of 7.5 hours. The reaction mixture was poured into 2 liters of acetone. The resulting precipitate was stirred for 1.5 hours, and the acetone was removed by decantation. Fresh acetone was added to the solid, and the slurry was again stirred for 1.5 hours. The product was removed by filtration and washed with acetone. The air-dried quaternized polymer shown above weighed 105 grams.

EXAMPLE 6

Preparation of:

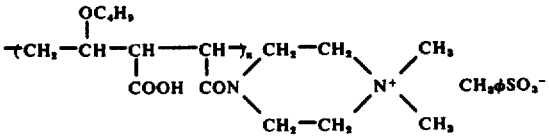

In a manner analogous to Examples 4 and 5, the N-methylpiperazine carboxamide derivative of butylvinylethermaleic acid copolymer shown above was formed using a butylvinylether-maleic acid copolymer (relative viscosity in 1% methyl ethyl ketone = 1.59) in place of the GANTREZ A-119.

EXAMPLE 7

Preparation of:

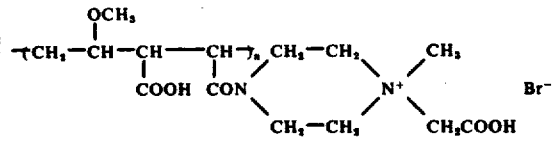

Following the procedure of Example 5, but using bromoacetic acid as the alkylating agent, the amphoteric copolymer above was prepared.

EXAMPLE 8

Preparation of:

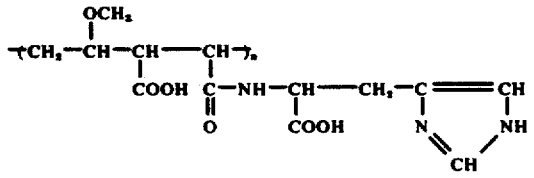

To a stirred solution of 39.9g (0.2 mol) of L-histidine monohydrochloride hydrate and 40.4g (0.3 mol) of triethylamine in 300 ml water, was added dropwise, a solution of 31.2g (0.2 mol) of methylvinylether-maleic anhydride copolymer (GANTREZ AN-119) in 200 ml of dimethylformamide, and the whole was heated on a steam bath for 8 hours. The cooled solution was poured into 2 liters of acetone, and the resulting gummy precipitate was washed by decantation with acetone. The semi-solid material was triturated with absolute ethanol, removed by filtration and dried in a vacuum. The copolymer shown above was obtained in a yield of 62.5 grams.

EXAMPLE 9

Preparation of:

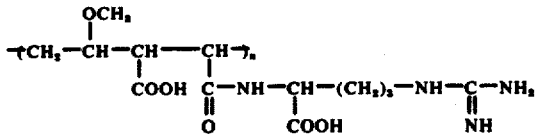

To a heated (90°–95° C) solution of 42g (0.2 mol) of L-arginine hydrochloride and 1.5g sodium hydroxide in 50 ml water and 100 ml dimethylformamide, there was slowly added a solution of methylvinylether-maleic anhydride copolymer (GANTREZ AN-119) in 250 ml dimethylformamide, and the whole was heated on a steam bath for approximately 16 hours. The cooled mixture was poured into 2 liters of acetone, and the solid material, which separated, was removed by filtration. The product was ground in a blender with acetone, again removed by filtration, and washed with acetone. The yield of the above copolymer was 65g.

EXAMPLE 10

Preparation of:

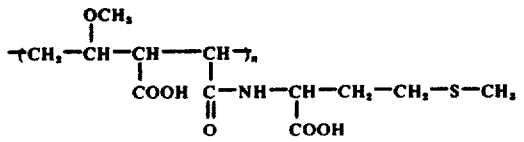

A solution of 15.6g (0.1 mol) of methylvinylether-maleic anhydride copolymer (GANTREZ AN-119) in 100 ml of dimethylformamide was slowly added at a temperature of 35°–40° C to a stirred solution of 29.8g (0.2 mol) of DL-methionine and 8.0g (0.2 mol) of sodium hydroxide in 300 ml water. A white solid precipitated from the reaction mixture. After an 8 hr. heating period on a steam bath, the solid material had dissolved completely. The cooled solution was poured in 3 liters of acetone, and the gummy precipitate, which separated, was washed by decantation with fresh acetone until solidification occurred. The product was removed by filitration, washed with anhydrous acetone, ground to a fine powder and dried in a vacuum. The copolymer above was obtained in a yield of 46.5g.

In Examples 8, 9 and 10 the bifunctional reactant contains a primary amino group, and hence formation of the cyclic imide structure (Ic) as a secondary reaction product, is possible. Such structures would still contain both anionic and cationic groups in view of the carboxy group carried by the primary amino reactant. Thus, cyclic imides formed in the reaction of Examples 8 through 10 would have the structures 8'–10' shown below, respectively.

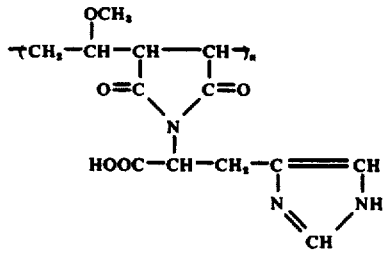

(8')

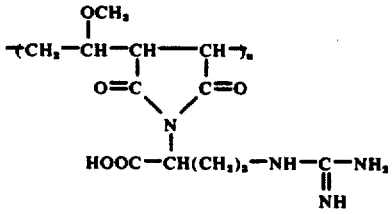

(9')

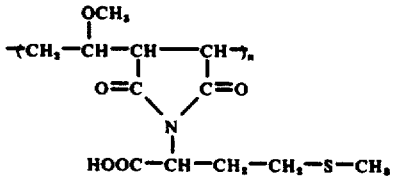

(10')

EXAMPLE 11

Preparation of:

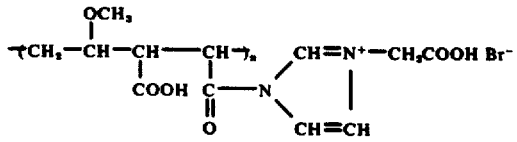

To a stirred solution of 13.8g (0.2 mol) of imidazole in 50 ml of acetone there was slowly added a solution of 15.6g (0.1 mol) of methylvinylether-maleic anhydride copolymer (GANTREZ AN-119) in 110 ml acetone, and the whole was allowed to stir at room temperature for 8 hours. The acetone was removed from the semi-solid precipitate by decantation, and the gummy residue was triturated with anhydrous ethyl ether until solidification occured. The vacuum dried material weighed 22.9g.

A solution of 22g of the preceding product in 100 ml dimethylformamide was slowly treated with a solution of 24.1g (0.18 mols) of bromoacetic acid in 25 ml dimethylformamide, and the mixture was heated on a steam bath for 3 hrs. The cooled solution was poured in acetone, whereupon an oily material separated. The acetone was removed by decantation, and the oily residue was triturated with petroleum ether (bp. 30°–60°) until solidification occurred. The vacuum dried polymer above weighed 23 grams.

EXAMPLES 12–42

In Examples 12–42 below, silver halide photographic emulsions were prepared by the emulsion preparation procedure A or B below, with or without the addition of a cationic surface-active agent. Table I tabulates the emulsion procedure used, the silver halide content of the emulsion and the amount and identity of the copolymer and the cationic surface-active agent. The structures for the surface-active agents are set forth in Table II.

Emulsion procedures A and B, referred to in Table I, are as follows:

Emulsion Procedure A

| | | | |
|---|---|---|---|
| Part I | $H_2O$ | = | 100 ml |
| | KBr | = | 36 to 50g |
| | KI | = | 0.5 to 7g |
| Amphoteric Copolymer (I) (20% solution in $H_2O$) | | = | 2 to 100 ml |
| Cationic Surface-Active Agent (1% solution in $H_2O$ or methanol | | = | 0 to 50 ml |

Adjust pH to 3.5 – 6.0 (with, for example, 1N NaOH or $Na_2CO_3$ or 1N $H_2SO_4$, depending on initial pH)

| | | | |
|---|---|---|---|
| Part II | $H_2O$ | = | 500 ml |
| | $AgNO_3$ | = | 50g |

-continued

Emulsion Procedure A

| | | | |
|---|---|---|---|
| Part III | $H_2O$ | = | 25 ml |
| | Gelatin | = | 5g |

Add Part II to Part I at a temperature range of 50° to 70° C and over a time period of 1 min. to 2 hrs. (depending on crystal sizes desired).

Add Part III gelatin solution.

Cool to 40° C.

Precipitate with 300 to 500 ml of ammonium sulfate (50%).

Wash precipitate 4 times by decantation.

Reconstitute washed precipitate with 64g gelatin (or any other gelatin compatible polymer) in 350 ml water.

Add sufficient water to make 800g of unsensitizedemulsion.

Emulsion Procedure B

| | | | |
|---|---|---|---|
| Part I | $H_2O$ | = | 100 ml |
| | KBr | = | 36 to 50g |
| | KI | = | 0.5 to 7g |
| | Gelatin | = | 0.5 to 10g |
| Amphoteric Polymer (I) (20% solution in $H_2O$) | | = | 2 to 100 ml |
| Cationic Surface-Active Agent (1% solution in $H_2O$ or methanol) | | = | 0 to 50 ml |

Adjust pH to 3.5 – 6.0 (with, for example, 1N NaOH or $Na_2CO_3$ or 1N $H_2SO_4$, depending on initial pH)

| | | | |
|---|---|---|---|
| Part IIA | $H_2O$ | = | 500 ml |
| | $AgNO_3$ | = | 50g |

Proceed as with Emulsion Procedure A, but omit the part III gelatin.

The emulsions of Examples 12–42, prepared according to procedures A and B, are sensitized to optimum speed and gradation, as determined by the inherent crystal size and distribution, by the usual procedure using such sensitizers as described above.

TABLE I

| | | | Photographic Emulsion | | | Copolymer | | Cationic Surface-Active Agent | |
|---|---|---|---|---|---|---|---|---|---|
| FIG. | Example | Emulsion Procedure | Mol % AgI | Mol % AgBr | Mol % AgCl | Example | Wgt/ 50g $AgNO_3$ | Structure No. | Wgt/ 50g $AgNO_3$ |
| 1 | 12 | A | 8 | 92 | — | 1 | 2.5g | — | — |
| 2 | 13 | A | 8 | 92 | — | 2 | 2.5 | — | — |
| 3 | 14 | A | 10 | 90 | — | 3 | 5.0 | — | — |
| 4 | 15 | A | 10 | 90 | — | 4 | 5.0 | — | — |
| 5 | 16 | A | 10 | 90 | — | 5 | 2.5 | — | — |
| 6 | 17 | A | 10 | 90 | — | 6 | 5.0 | — | — |
| 7 | 18 | A | 8 | 92 | — | 7 | 5.0 | — | — |
| 8 | 19 | A | 8 | 92 | — | 8 | 10.0 | — | — |
| 9 | 20 | A | 8 | 92 | — | 9 | 2.5 | — | — |
| 10 | 21 | A | 8 | 92 | — | 10 | 5.0 | — | — |
| 11 | 22 | A | 8 | 92 | — | 11 | 1.5 | — | — |
| 12 | 23 | A | 2 | 95 | 3 | 5 | 2.5 | — | — |
| 13 | 24 | A | 4 | 95 | 1 | 5 | 5.0 | — | — |
| 14 | 25 | A | 4 | 90 | 6 | 5 | 2.5 | — | — |
| 15 | 26 | B | 10 | 90 | — | 5 | 2.5 | — | — |
| 16 | 27 | B | 10 | 90 | — | 5 | 2.5 | 115 | 0.04 |
| 17 | 28 | B | — | 100 | — | 5 | 2.5 | 115 | 0.04 |
| 18 | 29 | B | 2 | 98 | — | 5 | 2.5 | 115 | 0.04 |
| 19 | 30 | B | 2 | 98 | — | 5 | 2.5 | 115 | 0.04 |
| 20 | 31 | B | 2 | 98 | — | 5 | 2.5 | 115 | 0.04 |
| 21 | 32 | B | 10 | 90 | — | 5 | 2.5 | 115 | 0.01 |
| 22 | 33 | B | 10 | 90 | — | 5 | 2.5 | 115 | 0.10 |
| 23 | 34 | B | 10 | 90 | — | 5 | 2.5 | 115 | 0.20 |
| 24 | 35 | B | 2 | 98 | — | 5 | 2.5 | 116 | 0.20 |
| 25 | 36 | B | 2 | 98 | — | 5 | 2.5 | 117 | 0.20 |
| 26 | 37 | B | 2 | 98 | — | 5 | 2.5 | 118 | 0.05 |
| 27 | 38 | B | 10 | 90 | — | 5 | 2.5 | 118 | 0.10 |
| 28 | 39 | B | 10 | 90 | — | 5 | 2.5 | 119 | 0.05 |
| 29 | 40 | B | 10 | 90 | — | 5 | 2.5 | 120 | 0.12 |
| 30 | 41 | B | 2 | 98 | — | 5 | 2.5 | 121 | 0.06 |
| 31 | 42 | B | 10 | 90 | — | 5 | 2.5 | 121 | 0.06 |

TABLE II

| Structure No. | Cationic Surface-Active Agents<br>Structure |
|---|---|
| 115 | $C_{12}H_{25}NH-\underset{\underset{NH}{\parallel}}{C}-NH_2 \cdot CH_3\phi SO_3H$ |
| 116 | 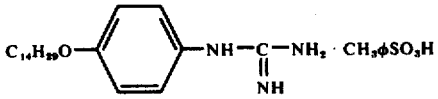 |
| 117 | $C_{12}H_{25}NH-\underset{\underset{NH}{\parallel}}{C}-NH-\underset{\underset{NH}{\parallel}}{C}-NH_2 \cdot CH_3\phi SO_3H$ |
| 118 | $C_{15}H_{31}CONH-\overset{\overset{CH_3}{\mid}}{\underset{\underset{CH_3}{\mid}}{N^+}}-CH_3 \cdot CH_3\phi SO_3^-$ |
| 119 | $C_{15}H_{31}CONH-(CH_2)_3-\overset{\overset{CH_3}{\mid}}{\underset{\underset{CH_3}{\mid}}{N^+}}-CH_3 \cdot CH_3\phi SO_3^-$ |
| 120 | $C_{17}H_{35}CONH-CH_2CONH-(CH_2)_3-\overset{\overset{CH_3}{\mid}}{\underset{\underset{CH_3}{\mid}}{N^+}}-CH_3 \cdot CH_3\phi SO_3^-$ |
| 121 | $C_{16}H_{33}SO_2-(CH_2)_3-\overset{\overset{CH_3}{\mid}}{\underset{\underset{CH_3}{\mid}}{N^+}}-CH_3 \cdot CH_3\phi SO_3^-$ |

Electron photomicrographs were prepared for each of the emulsions of Examples 12–42 and are shown in FIGS. 1–31, respectively. The crystal size and crystal size distribution of each of these emulsions can be seen from these Figures. The electron photomicrographs were prepared at a magnification of 10,000 X, and FIGS. 1–31 present these photomicrographs at a reduction of about one-third. To aid in reading FIGS. 1–31, the scale of FIG. 1 is shown, and each of FIGS. 2–31 is to the same scale as FIG. 1.

What is claimed is:

1. A photographic silver halide emulsion, wherein the emulsion binder comprises a water-soluble, film-forming amphoteric copolymer having in its molecule repeating units of the general formula:

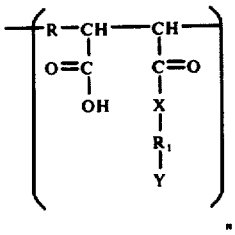

where

*n* is a positive integer;

R is the residue of an ethylenically unsaturated organic monomer;

X is

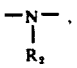

—S— or —O—, where $R_2$ is hydrogen or lower alkyl;

$R_1$ is lower alkylene, lower alkylene substituted by halogen, alkoxy or carboxy, cycloalkylene of 3 to 8 carbon atoms, or phenylene; and Y is

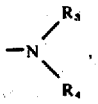

where $R_3$ and $R_4$ are each hydrogen, lower alkyl or lower alkyl substituted by amino, or $R_3$ and $R_4$ together with the nitrogen atom to which they are attached form a 3- 8-membered saturated or unsaturated heterocyclic ring containing the nitrogen atom as the sole hetero atom or containing a second hetero atom selected from nitrogen, oxygen or sulfur,

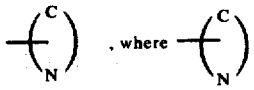

represents a 3-to 8-membered saturated or unsaturated heterocyclic ring containing the nitrogen atom in the ring as the sole hetero atom or containing a second hetero atom selected from nitrogen, oxygen or sulfur,

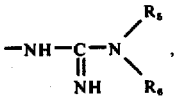

where $R_5$ and $R_6$ are each hydrogen or lower alkyl,

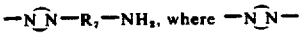

represents a 3- to 8-membered saturated or unsaturated heterocyclic ring containing the two nitrogen atoms as the sole heteroatoms and $R_7$ is lower alkylene, or $-SR_8$, where $R_8$ is hydrogen or lower alkyl;

or, when X is as defined above and Y is

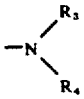

or $-SR_8$, $R_1$ represents the atoms necessary to form a 3- to 8-membered heterocyclic ring with X and Y containing X and Y as the sole hetero atoms;

and the quaternary ammonium salts thereof when Y is

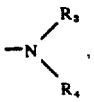

where $R_3$ and $R_4$ are lower alkyl or the ternary sulfonium salts thereof when Y is —S—$R_8$, where $R_8$ is lower alkyl.

2. The silver halide emulsion according to claim 1, wherein the emulsion binder includes gelatin or a modified gelatin.

3. The silver halide emulsion according to claim 2, wherein the gelatin or modified gelatin is in an amount of up to about 2500% by weight, based on the weight of the amphoteric copolymer.

4. The silver halide emulsion according to claim 1, wherein *n* is in the range of from 20 to 5000.

5. The silver halide emulsion according to claim 1, wherein R is

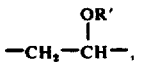

where R′ is lower alkyl, and *n* is in the range of from 35 to 3500.

6. The silver halide emulsion according to claim 5, wherein R′ is methyl or n-butyl.

7. The silver halide emulsion according to claim 1, wherein the amphoteric copolymer is in an amount of from about 1.0 to about 70 grams per mol of silver halide.

8. The silver halide emulsion according to claim 1, including a surface-active cationic agent having an aliphatic chain of from 8 to 18 carbon atoms in an amount of up to 5% by weight based on the amphoteric copolymer.

9. The silver halide emulsion according to claim 1, wherein at least a portion of said repeating units have the formula:

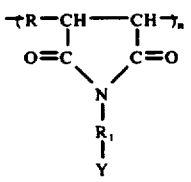

where $R_1$ is lower alkylene substituted by carboxy and R, Y and *n* are as defined in claim 1.

10. The silver halide emulsion according to claim 1, wherein the amphoteric copolymer has the formula:

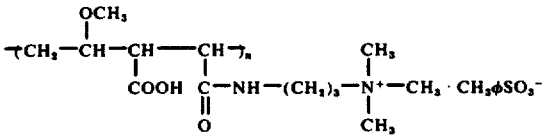

11. The silver halide emulsion according to claim 1, wherein the amphoteric copolymer has the formula:

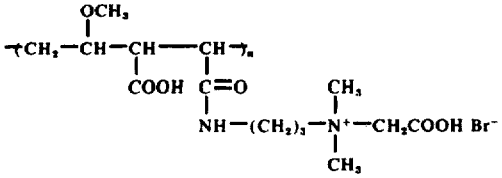

12. The silver halide emulsion according to claim 1, wherein the amphoteric copolymer has the formula:

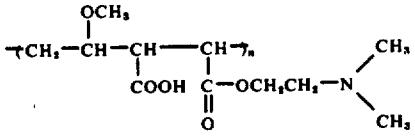

13. The silver halide emulsion according to claim 1, wherein the amphoteric copolymer has the formula:

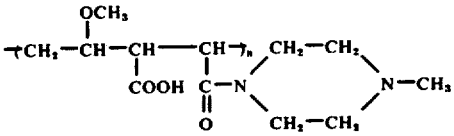

14. The silver halide emulsion according to claim 1, wherein the amphoteric copolymer has the formula:

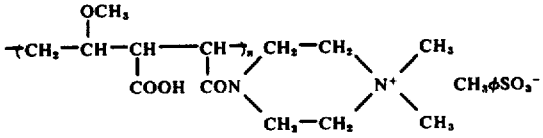

15. The silver halide emulsion according to claim 1, wherein the amphoteric copolymer has the formula:

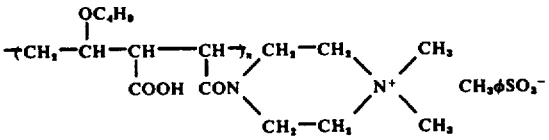

16. The silver halide emulsion according to claim 1, wherein the amphoteric copolymer has the formula:

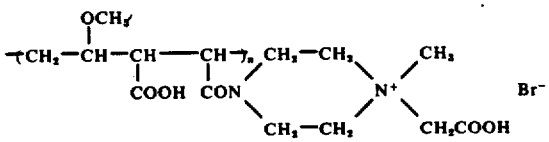

17. The silver halide emulsion according to claim 1, wherein the amphoteric copolymer has the formula:

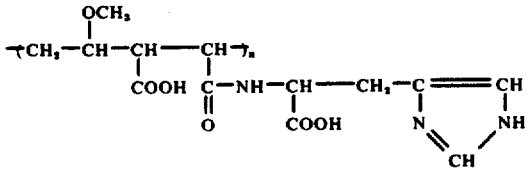

18. The silver halide emulsion according to claim 1, wherein the amphoteric copolymer has the formula:

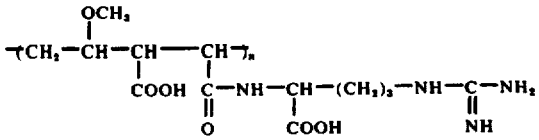

19. The silver halide emulsion according to claim 1, wherein the amphoteric copolymer has the formula:

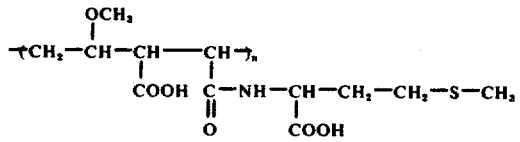

20. The silver halide emulsion according to claim 1, wherein the amphoteric copolymer has the formula:

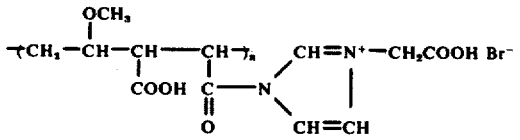

21. A method of preparing a photographic silver halide emulsion, comprising reacting a water-soluble silver salt with a water-soluble alkali metal halide in an aqueous solution of a water-soluble, film-forming amphoteric copolymer having in its molecule repeating units of the general formula:

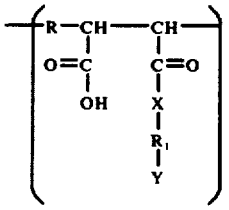

where $n$ is a positive integer;

R is the residue of an ethylenically unsaturated organic monomer;

X is

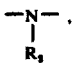

—S— or —O—, where $R_2$ is hydrogen or lower alkyl;

$R_1$ is lower alkylene, lower alkylene substituted by halogen, alkoxy or carboxy, cycloalkylene of 3 to 8 carbon atoms, or phenylene; and Y is

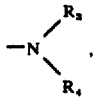

where $R_3$ and $R_4$ are each hydrogen, lower alkyl or lower alkyl substituted by amino, or $R_3$ and $R_4$ together with the nitrogen atom to which they are attached form a 3- to 8-membered saturated or unsaturated heterocyclic ring containing the nitrogen atom as the sole hetero atom or containing a second hetero atom selected from nitrogen, oxygen or sulfur,

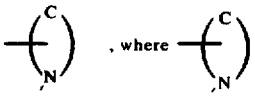

represents a 3- to 8-membered saturated or unsaturated heterocyclic ring containing the nitrogen atom in the ring as the sole hetero atom or containing a second hetero atom selected from nitrogen, oxygen or sulfur,

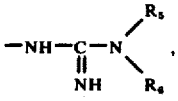

where $R_5$ and $R_6$ are each hydrogen or lower alkyl,

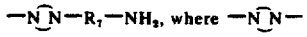

represents a 3- to 8-membered saturated or unsaturated heterocyclic ring containing the two nitrogen atoms as the sole heteroatoms and $R_7$ is lower alkylene, or $—SR_8$, where $R_8$ is hydrogen or lower alkyl; or when X is as defined above and Y is

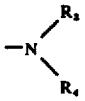

or $—SR_8$, $R_1$ represents the atoms necessary to form a 3- to 8-membered saturated or unsaturated heterocyclic ring with X and Y and containing X and Y as the sole hetero atoms; and the quaternary ammonium salts thereof when Y is

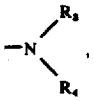

where $R_3$ and $R_4$ are lower alkyl or the ternary sulfonium salts thereof when Y is $—S—R_8$, where $R_8$ is lower alkyl.

22. The method according to claim 21, wherein said aqueous solution includes gelatin or a modified gelatin.

23. The method according to claim 22, wherein the gelatin or modified gelatin is in an amount of up to about 2500% by weight, based on the weight of the amphoteric copolymer.

24. The method according to claim 21, wherein $n$ is in the range of from 20 to 5000.

25. The method according to claim 21, wherein R is

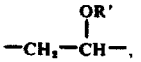

where R′ is lower alkyl, and $n$ is in the range of from 35 to 3500.

26. The method according to claim 25, wherein R′ is methyl or n-butyl.

27. The method according to claim 21, wherein the amphoteric copolymer is in an amount of from about 1.0 to about 70 grams per mol of silver halide.

28. The method according to claim 21, wherein said aqueous solution includes a surface-active cationic agent having an aliphatic chain of from 8 to 18 carbon atoms in an amount of up to 5% by weight based on the amphoteric copolymer.

29. The method according to claim 21, wherein at least a portion of said repeating units have the formula:

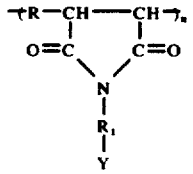

where $R_1$ is lower alkylene substituted by carboxy and R, Y and *n* are as defined in claim 21.

30. The method according to claim 21, wherein the amphoteric copolymer has the formula:

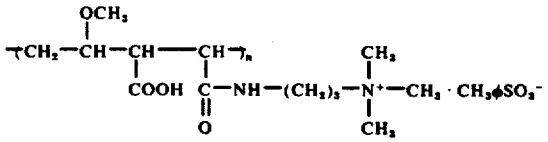

31. The method according to claim 21, wherein the amphoteric copolymer has the formula:

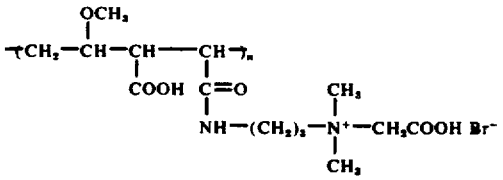

32. The method according to claim 21, wherein the amphoteric copolymer has the formula:

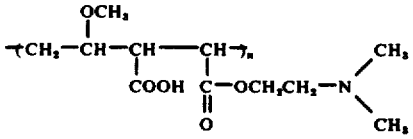

33. The method according to claim 21, wherein the amphoteric copolymer has the formula:

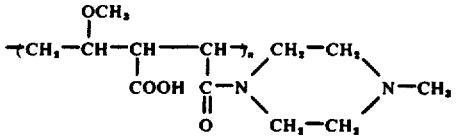

34. The method according to claim 21, wherein the amphoteric copolymer has the formula:

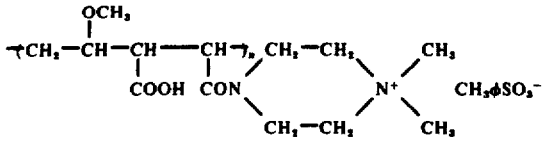

35. The method according to claim 21, wherein the amphoteric copolymer has the formula:

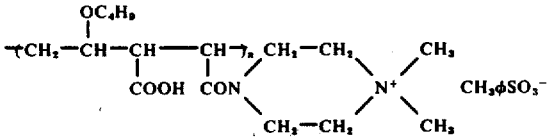

36. The method according to claim 21, wherein the amphoteric copolymer has the formula:

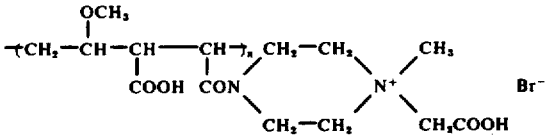

37. The method according to claim 21, wherein the amphoteric copolymer has the formula:

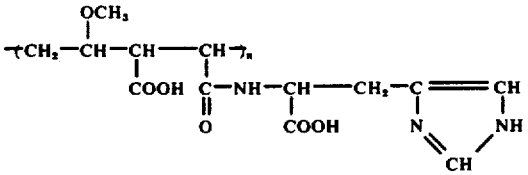

38. The method according to claim 21, wherein the amphoteric copolymer has the formula:

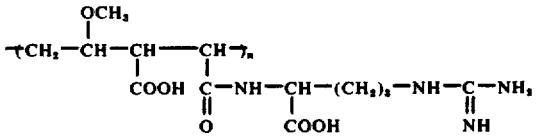

39. The method according to claim 21, wherein the amphoteric copolymer has the formula:

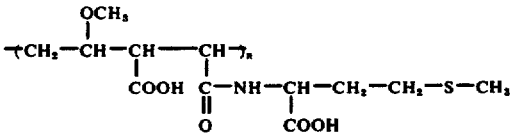

40. The method according to claim 21, wherein the amphoteric copolymer has the formula:

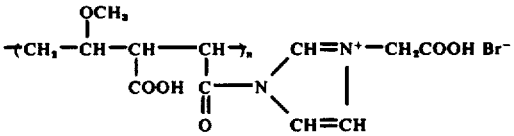

41. The silver halide emulsion according to claim 8, wherein said surface-active cationic agent is selected from the group consisting of:

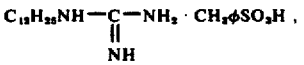

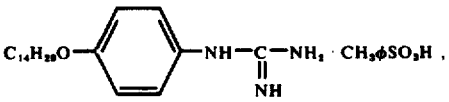

-continued
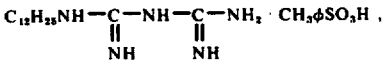
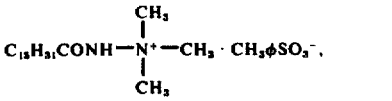
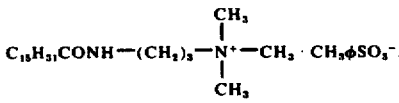
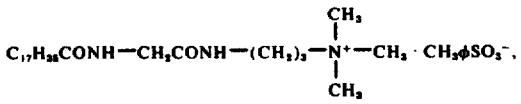
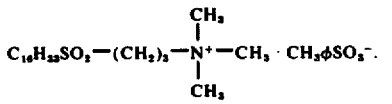
42. The method according to claim 28, wherein said surface-active cationic agent is selected from the group consisting of:
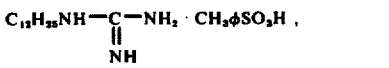
-continued
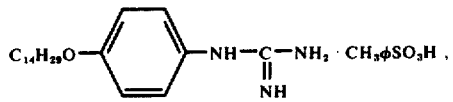
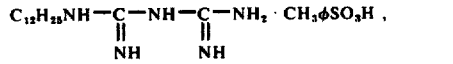
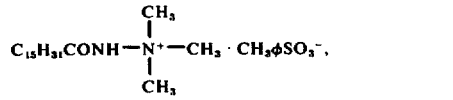
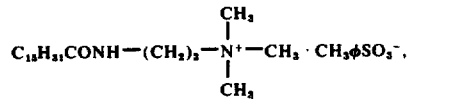
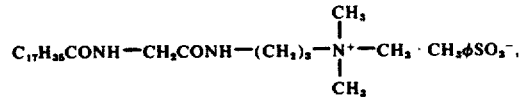
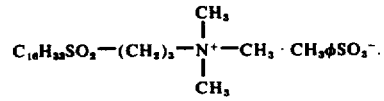
* * * * *